US005742468A

United States Patent [19]

Matsumoto et al.

[11] Patent Number: 5,742,468

[45] Date of Patent: Apr. 21, 1998

[54] ELECTRIC CHARGE GENERATOR FOR USE IN AN APPARATUS FOR PRODUCING AN ELECTROSTATIC LATENT IMAGE

[75] Inventors: Kazuya Matsumoto; Yukiaki Minamoto; Jun Funazaki; Michitsugu Arima; Masashi Kitazawa; Fumitaka Ozeki; Shigeru Komiyama, all of Tatsuno, Japan

[73] Assignee: Olympus Optical Co., Ltd., Tokyo, Japan

[21] Appl. No.: 541,684

[22] Filed: Oct. 10, 1995

[30] Foreign Application Priority Data

| | | | |
|---|---|---|---|
| Oct. 24, 1994 | [JP] | Japan | 6-282475 |
| Oct. 31, 1994 | [JP] | Japan | 6-288580 |
| Nov. 2, 1994 | [JP] | Japan | 6-269947 |
| Dec. 16, 1994 | [JP] | Japan | 6-333598 |
| Mar. 27, 1995 | [JP] | Japan | 7-091939 |

[51] Int. Cl.[6] ..... G03G 15/00

[52] U.S. Cl. ..... 361/229

[58] Field of Search ..... 361/225, 229, 361/230, 231, 235; 250/324–326; 399/168, 170–173

[56] References Cited

U.S. PATENT DOCUMENTS 4,783,716 11/1988 Nagase et al. ..... 361/225

*Primary Examiner*—Fritz Fleming

*Attorney, Agent, or Firm*—Armstrong, Westerman, Hattori, McLeland, & Naughton

[57] ABSTRACT

An electric charge generator for use in an apparatus for producing an electrostatic latent image includes a plurality of charge generation controlling devices, each charge generation controlling device including: an insulating substrate; a line electrode formed on the insulating substrate; a solid dielectric film formed on the surface of the line electrode; a finger electrode having a hole for generating an electric charge, the hole being formed in the central part of the finger electrode, the finger electrode being formed on the solid dielectric film; a solid insulating film having a hole for passing the electric charge, the hole being formed in the central part of the solid insulating film, the solid insulating film being formed on the finger electrode; and a screen electrode having a hole for ejecting the electric charge, the hole being formed in the central part of the screen electrode, the screen electrode being formed on the surface of the finger electrode via the solid insulating film; wherein the plurality of charge generation controlling devices are arranged on the insulating substrate so as to form the electric charge generator. The solid insulating film is formed of a multilayer solid insulating film including a surface-side layer made of an inorganic insulating film and a substrate-side layer made of an organic insulating film whereby the durability and the reliability are improved.

8 Claims, 24 Drawing Sheets

ELECTRIC CHARGE GENERATOR FOR USE IN AN APPARATUS FOR PRODUCING AN ELECTROSTATIC LATENT IMAGE

BACKGROUND OF THE INVENTION

1. Field of the Invention

The present invention relates to an electric charge generator for use in an apparatus for forming an electrostatic latent image, and also to a method of producing such an electric charge generator.

2. Description of the Related Art

It is known in the art, as disclosed for example in Japanese Patent Publication No. 2-62862 (1990), to use a corona discharge to generate an electric charge and transfer the generated charge directly onto a dielectric recording element so as to deposit the charge thereon thereby forming a latent image of electrostatic charge on the dielectric recording element. FIG. 1 is a cross-sectional view illustrating a part of the electric charge generator for use in an apparatus for forming an electrostatic latent image, disclosed in the patent cited above. In this figure, reference numeral 200 denotes a charge generation controlling device which is one of a plurality of similar devices forming the electric charge generator. The electric charge generator includes a large number of charge generation controlling devices 200 arranged in a one-dimensional or two-dimensional fashion. Each charge generation controlling device 200 includes: a line electrode 201 made of metal; a dielectric film 203; a finger electrode 205 made of metal, disposed in such a manner that they partially overlap with the above-described line electrode 201 via the dielectric film 203; an insulating film 207; and a screen electrode 209 made of metal, facing the finger electrode 205 via the insulating film 207 and space.

The charge generation controlling device 200 constructed in the above-described manner operates as follows. In FIG. 1, an AC voltage is applied by a power source 202 between the line electrode 201 and the finger electrode 205 disposed on the opposite sides of the dielectric film 203 so that a corona discharge occurs in a surface region 204 of the dielectric film 203 and thus a crowd of charges is produced in that region. Negative charges having a large mobility contained in the crowd of charges are used to form a latent image. If a voltage which is positive with respect to the voltage applied to the finger electrode 205 is applied to the screen electrode 209 located opposite to the finger electrode 205 via the insulating film 207, the negative charges produced by the corona discharge are extracted via a channel 206 and further via a screen hole 208 formed in the screen electrode 209. The negative charges extracted via the screen hole 208 are accelerated toward a drum 210 serving as the dielectric recording element and deposited on the surface of the drum 210 thereby forming an electrostatic latent image thereon. On the other hand, if a negative voltage with respect to the finger electrode 205 is applied to the screen electrode 209, the negative charges are prevented from being extracted via the screen hole 208. As a result, no electrostatic latent image is formed on the drum 210.

Referring to FIG. 2, a method of producing an electric charge generator according to a conventional technique is described below. FIG. 2 illustrates a conventional electric charge generator having a multilevel structure wherein levels are spread apart in the form of an exploded view so that the structure of each level can be seen. In FIG. 2, reference numeral 301 denotes a device supporting element (backbone) made of aluminum on which the electric charge generator is constructed. Reference numeral 302 denotes a glass-epoxy board of a usual type which is broadly used in conventional electric charge generators, and usually called an RF board. The surface of the glass-epoxy board 302 is coated with a thin copper film having a thickness of about 5 μm wherein the copper film is patterned into the form of a line electrode 303 by means of wet etching. Reference numeral 304 denotes a dielectric layer of mica having a thickness of about 35 μm and having a relative dielectric constant of about 16. Reference numeral 305 denotes a finger electrode formed by patterning a thin plate of stainless steel having a thickness of about 25 μm by means of wet etching. When the stainless steel plate is patterned, it is wet-etched from both sides so that the expansion of the finger holes in lateral directions is minimized.

Reference numeral 306 denotes an insulating film of Backrel available from Du Pont (more generally, an insulating film of a photo-setting laminated film) having a thickness of about 100 μm. This insulating film is also called a dynamask or confomask. As will be described later, the insulating film 306 is patterned after the insulating film 306 is bonded onto the finger electrode 305. Reference numeral 307 denotes a screen electrode formed by patterning a thin plate of stainless steel having a thickness of about 25 μm by means of wet etching. In the pattering process, the stainless steel is wet-etched from both sides as in the case of the finger electrode so that the expansion of the screen holes in lateral directions is minimized.

These elements described above are bonded one on another via an adhesive in the manner described below so as to obtain a complete electric charge generator. That is, first a dielectric layer 304 is bonded via an ultraviolet curing epoxy adhesive to a glass-epoxy board 302 on which the line electrode 303 has been formed. In this bonding, it is important to suppress the generation of voids in the adhesive to as low a level as possible. Furthermore, it is also important to coat the adhesive as uniformly as possible so that the dielectric layer 304 may have good uniformity. An adhesive called Densil, available from Dennison Co., (more generally, a silicone-based adhesive) is coated on the dielectric layer 304, and a finger electrode 305 is then bonded to the dielectric layer 304. In this bonding process, the finger electrode 305 is placed so that an alignment mark formed on the finger electrode is positioned relative to the corresponding alignment mark formed on the glass-epoxy board 302 using a microscopy, and a pressure is applied so that the finger electrode 305 and the glass-epoxy board 302 are pressed against each other so as to achieve bonding.

An insulating film 306 is then lamination-coated on the finger electrode 305. Then exposure, development, and wet etching are performed so as to form holes corresponding to the channel 206 shown in FIG. 1. In the above-described exposure process for forming the image of channel holes, an exposing mask is aligned relative to the alignment mark formed on the glass-epoxy board 302 or to the alignment mark formed on the finger electrode while observing the alignment marks via a microscope, and then exposure is performed. After the formation of the channel holes, a low viscosity silicone adhesive is coated on the insulating film 306 except charge generation regions, and then a screen electrode 307 is placed thereon so that the screen electrode 307 is bonded to the insulating film 306. When the screen electrode 307 is placed on the insulating film 306, alignment is performed while observing alignment marks via a microscope so that the alignment mark of the screen electrode comes to a correct location corresponding to the alignment mark formed on the glass-epoxy board 302. After completion of alignment, a pressure is applied so that the screen electrode 307 is pressed against the insulating film 306 thereby accomplishing the bonding. Finally, the glass-epoxy board 302 is bonded to a device supporting element 301 and thus a complete electric charge generator is obtained.

The conventional electric charge generator has various technical problems relating to each production process as will be described below. The problem in the process of forming the line electrode is the nonuniformity in thickness of the dielectric film 203 shown in FIG. 1. The nonuniformity in thickness of the dielectric film 203 causes variations in generated charges among pixels, which produce fixed pattern noise in an image reproduced, and thus degradation occurs in the quality of the reproduced image. As described above, the thickness of the dielectric film 203 shown in FIG. 1 is the sum of the thickness of the dielectric layer 304 shown in FIG. 2 and that of the ultraviolet curing epoxy adhesive. The thickness of the line electrode 201 produces steps of about 5 μm at its edges. The difficulty caused by the steps is that when the dielectric film 203 is bonded the above-described steps have to be covered with the ultraviolet curing epoxy adhesive in such a manner as to planarizing the steps so that the dielectric film 203 has a flat surface. Another problem in this process is that voids are generated when the adhesive is coated. The probability of generation of voids increases as the step of the line electrode 201 becomes greater.

Another problem of the conventional electric charge generator is that a large driving voltage is required to produce a corona discharge. Since the dielectric layer of mica is as thick as 35 μm as described above, it is required that the driving voltage be as great as about 2500 $V_{p-p}$ to generate a corona discharge. According to Paschen's law, it is possible to reduce the driving voltage down to about 700 $V_{p-p}$ under the atmospheric condition, if the thickness of the dielectric film is reduced. However, in practice, it is difficult to further reduce the thickness of the dielectric film (mica film) down to a value less than 35 μm according to the conventional technique. Besides, the reduction in the thickness of the dielectric film may cause another problem that the electrical strength of the dielectric film becomes lower. For the above reasons, a high driving voltage is used to generate a corona discharge.

The process of forming the finger electrode has the following problems. In the conventional electric charge generator having the above-described structure, the finger electrode 205 shown in FIG. 1 has a circular shape when viewed from above the generator, wherein the diameter R of the finger electrode 205 is set to about 150 μm for an electric charge generator having a resolution of 300 dpi (dots per inch) and about 75 μm for 600 dpi. Since the finger electrode formed according to the conventional technique has a thickness as large as about 25 μm and since it is formed by means of wet etching, the practical minimum diameter of finger holes is about 75 μm. This means that the highest possible resolution of the conventional electric charge generator is about 600 dpi. However, some applications require very high resolution greater than 1000 dpi, and the conventional electric charge generator cannot meet such the high-resolution requirement.

Furthermore, because of the large thickness of the finger electrode of the conventional electric charge generator, a large variation in the diameter of finger holes occurs during the patterning process. This variation in the diameter of finger holes causes degradation of image quality. Furthermore, when the dielectric film is bonded using an adhesive called Densil as described above, the adhesive also causes an increase in the thickness of the dielectric film and thus causes an additional variation in the thickness. The increase in the thickness of the dielectric film results in an increase in the discharge voltage, and the additional variation in the thickness causes further degradation of image quality. Furthermore, when the finger electrode is bonded while performing alignment using a stereoscopic microscope, a large alignment error (deviation) can occur.

In the process of forming the insulating film performed after the formation of the finger electrode, an insulting film called Backrel is lamination-coated as described above. When an insulating film having a thickness of 100 μm is formed by means of lamination coating, it is known that a large amount of nonuniformity greater than 20 μm occurs across the surface of the insulating film. Therefore, as in the case of the process of forming the dielectric film, the nonuniformity in the thickness of the insulating film can cause degradation of image quality. Furthermore, when channel holes are formed in the insulating film, a large alignment error (deviation) can occur when a mask pattern for the channel holes is aligned using a stereoscopic microscope as in the case of the process of bonding the finger electrode.

In the final process, the screen electrode is formed according to a process similar to that of the finger electrode, and thus this process also has a problem similar to that in the process of forming the finger electrode.

SUMMARY OF THE INVENTION

It is a general object of the present invention to solve the problems described above. More specifically, it is an object of the present invention to provide an electric charge generator for use in an apparatus for producing an electrostatic latent image, which is characterized in that the formation of thin films and the patterning thereof are performed using a high-precision production technique based on the semiconductor fabrication technology thereby achieving a reduction in the driving voltage and an improvement of the nonuniformity in the image quality, and also preventing a discharge between a finger electrode and a screen electrode in an electric charge generating part, and furthermore preventing a discharge between the screen electrode and a line electrode in the edge region of the screen electrode, and thus preventing these electrodes from being broken, whereby the reliability of the electric charge generator is improved.

This object is achieved by the invention in one aspect in which a solid insulating film is composed of a multilayer solid insulating film including an inorganic insulating film disposed on the surface side and an organic insulating film disposed on the substrate side.

It is a second object of the present invention to provide an electric charge generator for use in an apparatus for producing an electrostatic latent image, that is adapted to prevent the growth of aluminum hillocks when a line electrode is formed of aluminum which has a low resistivity and which can be easily processed or patterned with high accuracy using broadly-used semiconductor processing techniques thereby preventing degradation in the reliability of a solid dielectric film and also preventing a reduction in production yield.

This object is achieved by the invention in another aspect in which a thin film harder than aluminum is formed between an aluminum line electrode and a solid dielectric film.

It is a third object of the present invention to provide an electric charge generator for use in an apparatus for producing an electrostatic latent image, that is adapted to easily connect a line electrode to a line electrode pad by means of a multilayer interconnection technique based on a semiconductor production technique.

This object is achieved by the invention in still another aspect in which a part of an interconnection between the line electrode and the line electrode pad is formed using the same metal layer as that forming a finger electrode.

It is a fourth object of the present invention to provide an electric charge generator for use in an apparatus for producing an electrostatic latent image, that is adapted to prevent a reduction in the thickness of a solid dielectric film at a location near an edge of a line electrode thereby improving the durability of the solid dielectric film.

This object is achieved by the invention in further aspect in which the line electrode is embedded in an insulating substrate. This object is also achieved by the invention in another aspect in which a solid dielectric film is composed of first and second dielectric films and a coated-glass film disposed between the first and second dielectric films. This arrangement allows a reduction in the step of the solid dielectric film that occurs at a boundary between an area in which a line electrode is present under the solid dielectric film and an area in which no line electrode is present and thus allows an improvement in the thickness uniformity of the solid dielectric film. As a result, the variation in the amount of electric charge generated is minimized, and an abnormal concentration of electric field between the line electrode and a finger electrode formed on the solid dielectric film is reduced, and thus the image quality and the durability are improved.

It is a fifth object of the present invention to provide an electric charge generator for use in an apparatus for producing an electrostatic latent image, that is adapted to prevent damage of a dielectric film due to a corona discharge, and also prevent cracking of the dielectric film and bowing of a substrate thereby improving the durability of the solid dielectric film.

This object is achieved by the invention in still another aspect in which a protective insulating film denser and harder than the solid dielectric film is selectively formed in the surface area of the solid dielectric film corresponding to a hole formed in a finger electrode and also in an area near such the area. This protective insulating film prevents the surface of the solid dielectric film in the finger electrode hole from being eroded by an corona discharge and thus allows a great improvement in the durability of the solid dielectric film. Furthermore, since the proactive insulating film is formed in the surface area of the solid dielectric film corresponding to the finger electrode hole and also in the adjacent area, cracking of the solid dielectric film and bowing of the substrate can be absolutely avoided, and thus it is possible to achieve an electric charge generator capable of high-stability operation.

DESCRIPTION OF THE PREFERRED EMBODIMENTS

Figure 3:
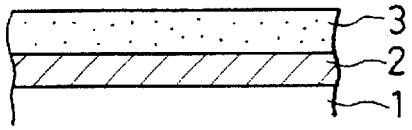
FIG. 3 is a schematic diagram illustrating the structure of an electric charge generator for use in an apparatus for forming an electrostatic latent image, according to a first embodiment of the present invention, wherein the structure obtained at a stage of a production process step is shown.

Preferred embodiments will be described below. FIGS. 3 to 9 are schematic diagrams illustrating the production process steps of an electric charge generator for use in an apparatus for forming an electrostatic latent image according to a first embodiment of the present invention wherein mainly one of the charge generation controlling devices included in the electric charge generator is illustrated in the form of cross-sectional views. In this embodiment, the production process steps of the electric charge generator for use in an apparatus for forming an electrostatic latent image are all based on semiconductor processing technology. In FIG. 3, reference numeral 1 denotes an insulating substrate made of an insulating material such as glass, quartz, or alumina, on which a great number of charge generation controlling devices are to be formed. A line electrode 2 is formed on the insulating substrate 1 by means of a patterning technique. The line electrode 2 may be formed either into a single layer structure using a material such as molybdenum, copper, aluminum, or titanium or into a multi-layer structure including for example titanium/aluminum, using a semiconductor film deposition technique such as sputtering or vacuum evaporation or otherwise using a plating technique so that the line electrode has a thickness in the range from 0.5 μm to 3 μm. After the deposition, the deposited material is patterned into the form of the line electrode 2 by means of photolithography and etching techniques which are commonly used in semiconductor production.

After the deposition and patterning of the line electrode 2, a dielectric film 3 such as silicon oxide or silicon nitride is deposited by means of a semiconductor film deposition technique such as a plasma CVD (plasma chemical vapor deposition) technique. If an insulating film having good dielectric strength, such as that usually used in semiconductor devices, is employed, 3 to 5 μm is enough as the thickness of the dielectric film 3. To improve the uniformity in the thickness of the dielectric film 3, it is desirable that the surface of the silicon oxide film deposited by means of plasma CVD be planarized by means of the spin-on-glass technique and then an additional silicon oxide film be deposited thereon. When such a multi-layer structure is employed, a thickness of 3 to 5 μm can be good enough as the total thickness of the dielectric film as in the case of the single-layer film described above.

Figure 4:
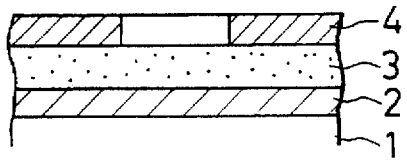
FIG. 4 is a schematic diagram illustrating the structure of the electric charge generator at the stage of the production process step following that of FIG. 3.

Then, as shown in FIG. 4, a thin metal film to be used as a finger electrode 4 is deposited on the dielectric film 3 by means of sputtering, vacuum evaporation or resistance heating. High-melting point metal such as molybdenum, titanium, or tungsten may preferably be employed as the material for the finger electrode 4. The thickness of the finger electrode 4 is preferably in the range from 0.5 to 2 μm. After depositing the metal film for the finger electrode, the metal film is patterned into the form of the finger electrode 4 by means of photolithography. In this photolithography process, the alignment is performed by aligning an alignment mark formed on a mask for the finger pattern relative to an underlying mark which was formed when the line electrode was formed. It is easy to achieve a small alignment error less than 1 μm using a photolithography technique widely used in semiconductor production. In the etching process of the finger electrode 4, it is preferable to employ a reactive ion etching (RIE) technique which can provide a good dimensional accuracy (patterning accuracy) and thus can provide a small variation in the size of the resultant pattern. However, if it is needed to prevent the surface of the dielectric film from being damaged by the reactive ion etching, a wet etching process in a chemical solution may also be employed. It is also preferable to employ the reactive ion etching technique in the process for forming other electrodes such as the screen electrode.

Then, a first insulating film 5 is formed on the finger electrode 4 by means of a coating technique such as spin coating or a screen printing technique. Preferably, the first insulating film 5 is made of polyimide or resist. The thickness of the first insulating film 5 is preferably in the range from 10 μm to 100 μm. For example when a polyimide film having a thickness of 50 μm is formed by means of the spin coating technique, it is possible to obtain a small thickness variation less than 1 μm.

Figure 5:
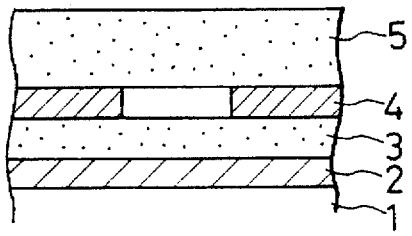
FIG. 5 is a schematic diagram illustrating the structure of the electric charge generator at the stage of the production process step following that of FIG. 4.
Figure 6:
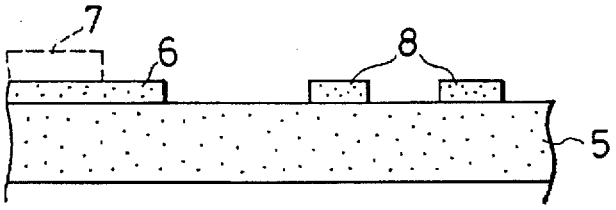
FIG. 6 is a schematic diagram illustrating the structure of the electric charge generator at the stage of the production process step following that of FIG. 5.

After obtaining the structure shown in FIG. 5 in the form of a cross-sectional view, a second insulating film 6 is deposited on the first insulating film 5. The second insulating film 6 may be formed either into a single layer structure using a material such as silicon oxide or silicon nitride or into a multi-layer structure consisting of for example a silicon oxide film and a silicon nitride film formed on the silicon oxide film by means of a semiconductor film deposition technique such as plasma CVD. The second insulating film 6 preferably has a thickness in the range from 0.5 μm to 1 μm. After depositing the second insulating film 6, unnecessary portions of the second insulating film 6 are removed by means of photolithography and etching. FIG. 6 is a schematic diagram illustrating a part of the second insulating film 6 located in an outer area relative to the position 7 at which the screen electrode will be formed later.

In FIG. 6, reference numeral 8 denotes an alignment mark formed of the second insulating film 6. In the example shown in FIG. 6, the second insulating film 6 extends outward beyond the edge of the area 7 in which the screen electrode will be formed. In the inner area in which the unnecessary portion of the second insulating film 6 is removed, the charge generation controlling device has, at this process stage, a cross-sectional structure which is the same as that shown in FIG. 5.

Figure 7:
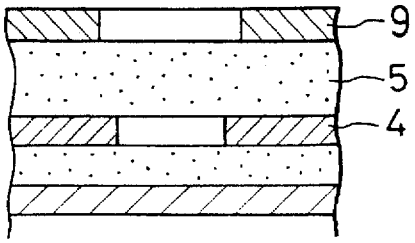
FIG. 7 is a schematic diagram illustrating the structure of the electric charge generator at the stage of the production process step following that of FIG. 6.

Then, as shown in FIG. 7, a thin metal film which will be patterned later into the screen electrode 9 is deposited on the first insulating film 5 or the second insulating film 6 by means of sputtering, vacuum evaporation or resistance heating. The screen electrode 9 may be formed either into a single layer structure using a high-melting point metal such as molybdenum, titanium, tungsten, or titanium nitride, or into a multi-layer structure consisting of for example a high-melting point metal layer of molybdenum, titanium, or tungsten and an aluminum layer deposited on the above high-melting point metal layer. The thickness of the screen electrode 9 is preferably in the range from 1 μm to 2 μm. After depositing the metal film for the screen electrode 9 on the entire area of the underlying structure, the deposited metal film is patterned into the screen electrode 9 by means of photolithography. It is preferable that the etching the screen electrode 9 be performed by the reactive ion etching (RIE) technique so as to achieve a good dimensional accuracy (patterning accuracy) and thus a small variation in the size of the resultant pattern.

Figure 8:
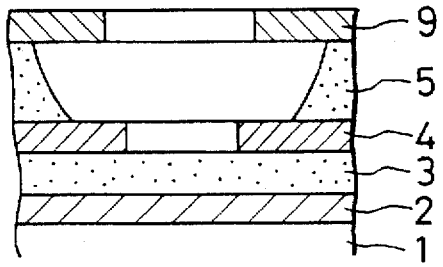
FIG. 8 is a cross-sectional view illustrating the structure of a complete charge generation controlling device of the electric charge generator according to the first embodiment of the invention.
Figure 9:
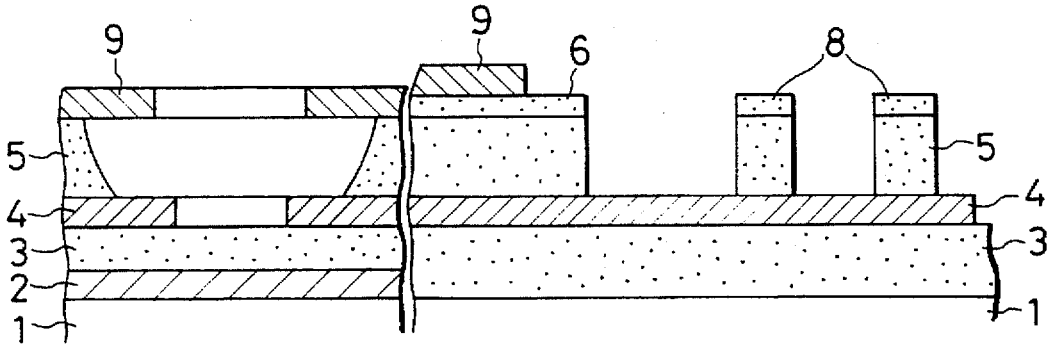
FIG. 9 is a cross-sectional view illustrating the structure of the device region of the complete charge generation controlling device of the electric charge generator as well as the structure of a part outside the device region, according to the first embodiment of the invention.

Subsequently, only the first insulating film 5 is selectively removed, as shown in FIG. 8, by mean of dry etching using an oxygen plasma or wet etching in a chemical solution using the screen electrode 9 and the second insulating film 6 as a mask. In an alternative etching technique for selectively removing only the first insulating film 5, the first insulating film 5 may be etched anisotropically until the surface of the finger electrode 4 is exposed, then the first insulating film 5 may be further etched isotropically so that the walls of the insulating film 5 go backward. This technique is especially useful for producing an electric charge generator for use in high-resolution applications. Thus, a complete electric charge generator according to the present embodiment of the invention is obtained. FIG. 9 illustrates the final structure of the screen electrode 9 and other portions near the screen electrode 9. As shown in FIG. 9, the second and first insulating films 6 and 5 extend outward beyond the edge of the screen electrode 9.

In this first embodiment, the alignment in the photolithography process for forming the screen electrode 9 is performed by aligning the alignment mark formed in the mask for patterning the screen electrode relative to an alignment mark 8, which is newly formed by using the second insulating film 6 when the second insulating film 6 is patterned. The alignment mark which was formed in the underlying layer such as the line electrode 2 before the deposition of the first insulating film 5 is covered, in the subsequent processes, with the first insulating film 5 having a large thickness and further with an opaque metal film for the screen electrode, and thus it becomes impossible to optically detect the alignment mark in the underlying layer. This means that this alignment mark cannot be used at all in the photolithography process for forming the screen electrode 9. In this embodiment, the above problem is avoided by using the alignment mark which is newly formed in the second insulating film 6 when the second insulating film 6 is patterned. A small alignment error less than 1 μm can be easily achieved using semiconductor production technology. Furthermore, the portions of the first and second insulating films extending outward beyond the edge of the screen electrode 9 serve to protect the surface of the electric charge generator.

Figure 10A:
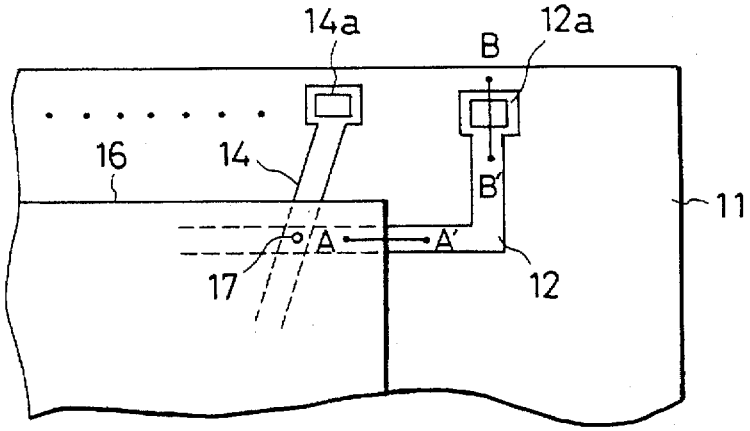
FIGS. 10A–10C are schematic diagrams illustrating the structure of a part outside the device region of a charge generation controlling device of an electric charge generator according to a second embodiment of the invention.
Figure 10B:
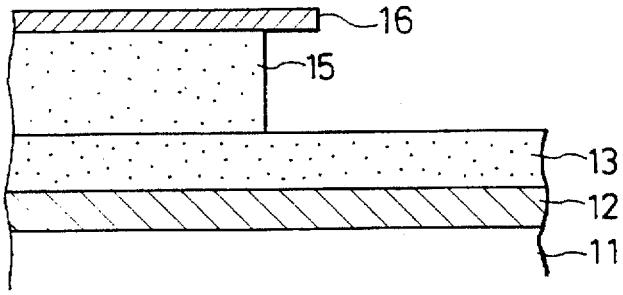
Figure 10C:
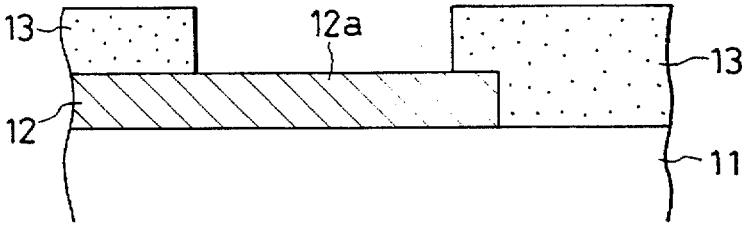

Referring to FIGS. 10A–10C, a second embodiment will be described below. FIG. 10A is a plan view partly illustrating the structure of the electric charge generator including a large number of charge generation controlling devices according to the second embodiment of the invention. FIGS. 10B and 10C are enlarged cross-sectional views of FIG. 10A taken along lines A–A' and B–B', respectively. As shown in FIGS. 10A–10C, the electric charge generator includes: an insulating substrate 11 made of for example quartz (glass); a line electrode 12; a dielectric film 13; a finger electrode 14; a first insulating film 15 made of for example polyimide; a screen electrode 16; a line electrode pad 12*a*; a finger electrode pad 14*a*; and a charge ejecting hole 17 formed in the screen electrode 16.

In this second embodiment, as shown in FIGS. 10B and 10C, the dielectric film 13 extends outward beyond the edge of the screen electrode 16 so that the entire area outside the screen electrode 16 except for the electrode pad 12*a* of the line electrode 12 is covered with the dielectric film 13. In this structure, the surface of the line electrode 12 is covered with the dielectric film 13 thereby protecting the line electrode 12. If the dielectric film 13 is formed using $SiO_2$ or SiN, it is possible to protect the line electrode 12 from erosion due to the external contamination or moisture.

Figure 11:
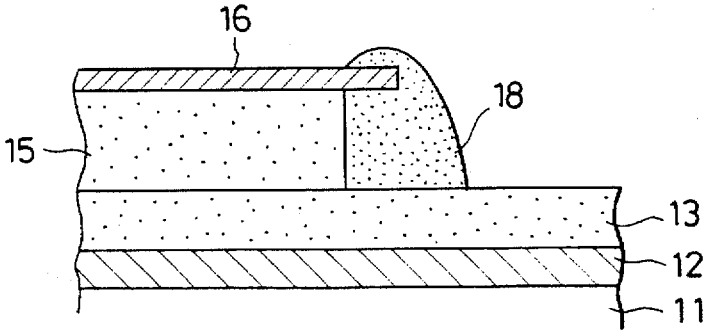
FIG. 11 is a schematic diagram illustrating a technique for solving a problem relating to the electric charge generator shown in FIGS. 10A–10C according to a second embodiment of the invention.

In the second embodiment described above, in some cases, the screen electrode 16 protrudes from the edge of the first insulating film 15 as shown in FIG. 10B. If there is such a protrusion, an undesirable corona discharge can occur between the line electrode 12 and the screen electrode 16 when the electric charge generator is driven. To avoid the above problem, side wall of the first insulating film 15 is covered with an epoxy resin 18 as shown in FIG. 11. However, the formation of the epoxy resin 18 requires a complicated process.

The above problem in the second embodiment is solved by a third embodiment described below, using the second insulating film employed in the first embodiment without requiring any additional process.

Figure 12A:
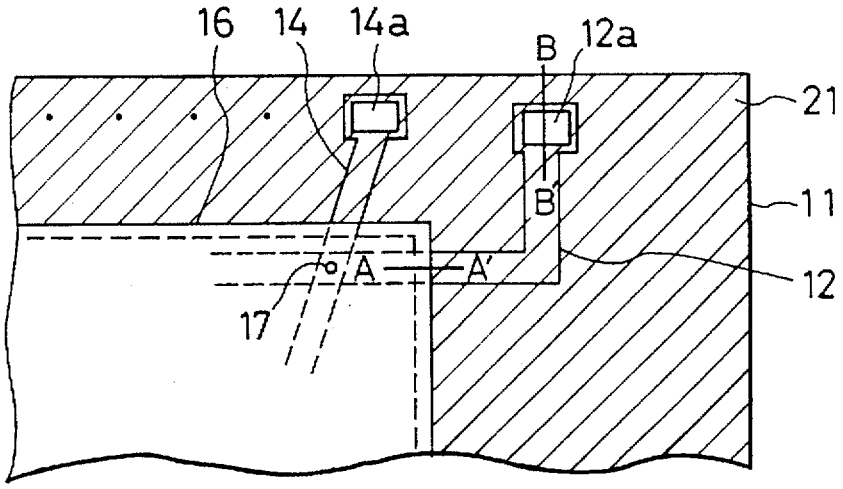
FIGS. 12A–12C are schematic diagrams illustrating the structure of the device region of a charge generation controlling device of an electric charge generator as well as the structure of a part outside the device region, according to a third embodiment of the invention.
Figure 12B:
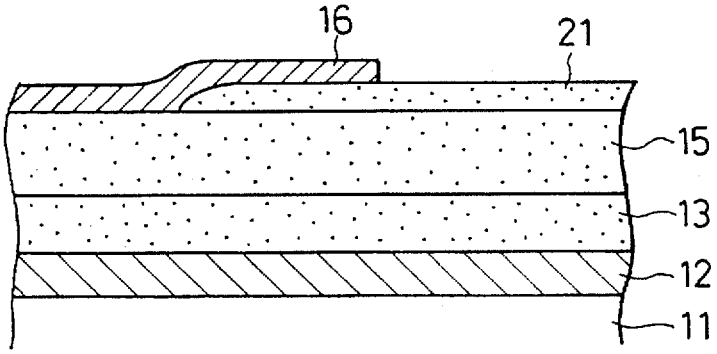
Figure 12C:
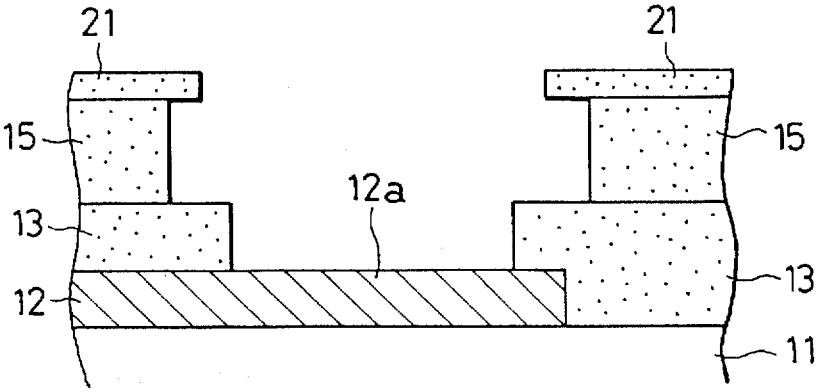

FIGS. 12A–12C illustrate the third embodiment according to the present invention, wherein FIG. 12A is a plan view partly illustrating the structure of tile electric charge generator, and FIGS. 12B and 12C are enlarged cross-sectional views of FIG. 12A taken along lines A–A' and B–B', respectively. In FIG. 12A–12C, those elements which are the same as or similar to the elements in the second embodiment are denoted by the same reference numerals, and these elements will not described here again. The structure shown in the plan view of FIG. 12A differs from that of the second embodiment shown in FIG. 10A in that the surface of the electric charge generator outside the area in which charge generation controlling devices are formed is covered with a second insulating film 21 except for the line electrode pad 12*a* and the finger electrode pad 14*a*. Furthermore, the second insulating film 21 is also formed under an edge portion of the screen electrode 16. Since the second insulating film 21 is formed in the above-described manner, the first insulating film 15 is also formed under the area on which the screen electrode 16 is not formed as shown in FIG. 12B. This arrangement has a great advantage that it is possible to prevent an undesirable corona discharge which would otherwise occur between the line electrode 12 and the screen electrode 16 when the electric charge generator is driven, without requiring any additional process such as that for coating an epoxy resin in the second embodiment.

Furthermore, the first and second insulating films 15 and 21 are formed over the area so that the films extend to locations near the electrode pads 12*a* and 14*a* as shown in FIG. 12C. In the case of the second embodiment, unlike the third embodiment, the finger electrode 14 is exposed to the outside in the area outside the screen electrode. As a result, dust or a particle having electrical conductivity can form a bridge between the finger electrodes 14. In this case, these finger electrodes are short-circuited, and thus an incorrect operation will occur in the electric charge generator. In contrast, in the third embodiment, the line electrode 12 and the finger electrode 14 in the area outside the screen electrode are covered with the first and second thick insulating films 15 and 21, and thus the problem in the second embodiment no longer occurs. Furthermore, since the surface of the first insulating film is protected by the second insulating film made of for example silicon oxide or silicon nitride, the reliability of the electric charge generator itself is improved.

Figure 13A:
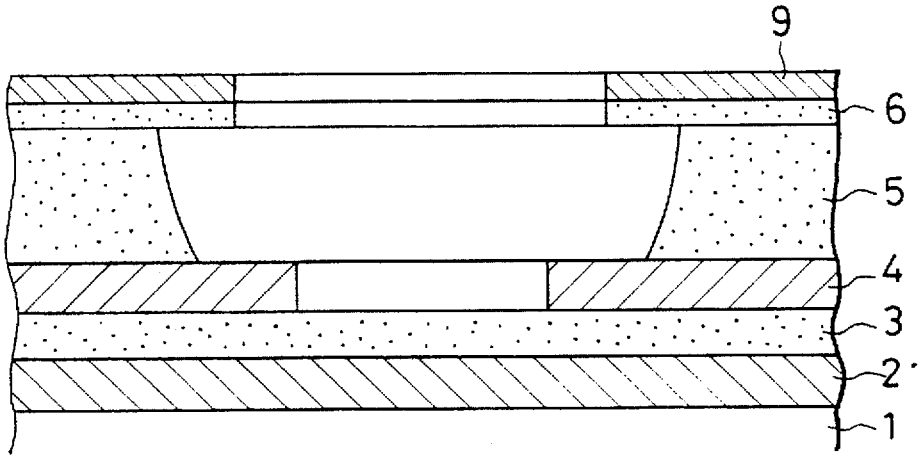
FIGS. 13A–13C are cross-sectional views illustrating an electric charge generator according to a fourth embodiment of the invention as well as a modification of thereof.

Now, a fourth embodiment will be described below. FIG. 13A is a cross-sectional view of a charge generation controlling device of the fourth embodiment, which is one of the similar devices forming an electric charge generator for use in an apparatus for generating an electrostatic latent image. In FIG. 13A, the same or similar elements as those in the first embodiment shown in FIG. 8 are denoted by the same reference numerals as those in FIG. 8. The charge generation controlling device of this embodiment is the same as that of the first embodiment in that it includes: an insulating substrate 1; a line electrode 2 made of metal; a dielectric film 3; a finger electrode 4 made of metal; a first insulating film 5; and a screen electrode 9 made of metal. However, it is different in that a second insulating film 6 is formed just under the screen electrode 9. If a large voltage is applied between the finger electrode 4 and the screen electrode 9, there is a possibility that the finger electrode 4 or the screen electrode 9 are broken by a discharge breakdown. However, in this embodiment, the second insulating film 6 serves to cut off the discharging current and thus the above problem does not occur.

Figure 13B:
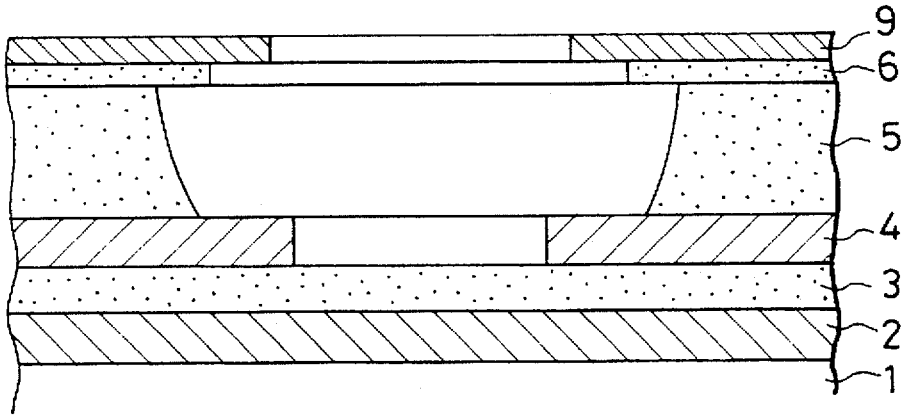
Figure 13C:
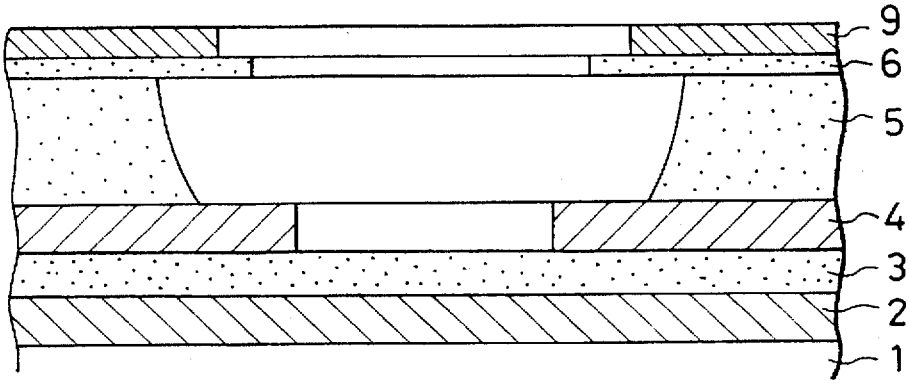

FIGS. 13B and 13C illustrate variations of the fourth embodiment. In the modified embodiment shown in FIG. 13B, the screen electrode 9 extends beyond the edge of the second insulating film 6 so that an overhanging structure is formed. On the other hand, in the modified embodiment shown in FIG. 13C, the edge of the screen electrode 9 is located at an inner position relative to the edge of the second insulating film 6. Either modification can provide advantages similar to the fourth embodiment.

Figure 14A:
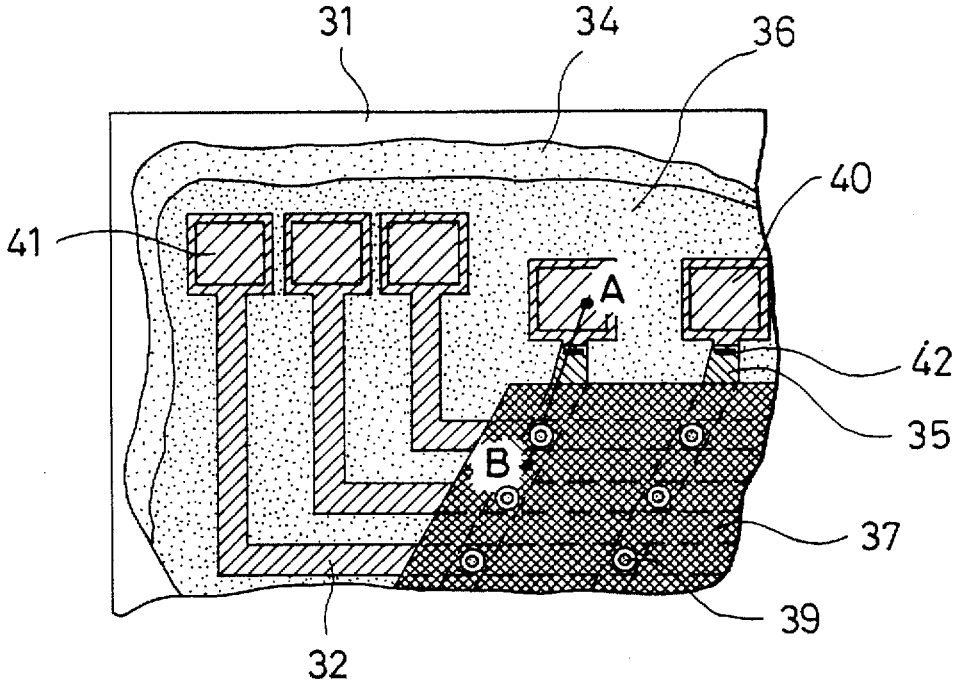
FIGS. 14A and 14B are schematic diagrams illustrating the planar and cross-sectional structures of an electric charge generator according to a fifth embodiment of the invention.
Figure 14B:
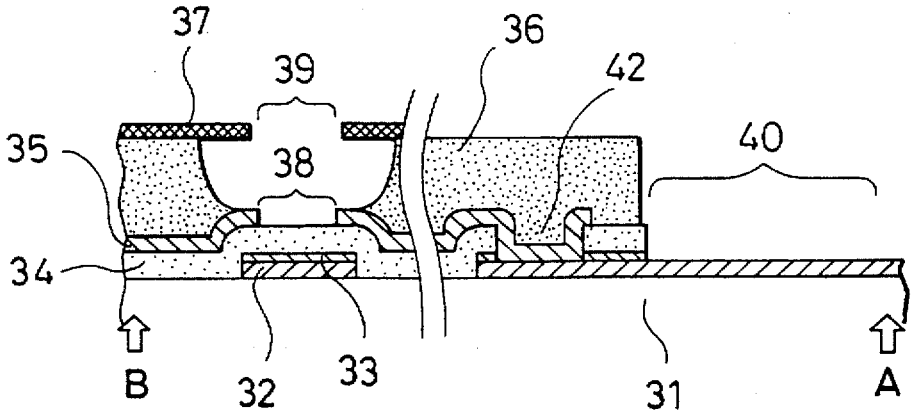

Now, a fifth embodiment will be described below. FIG. 14A is a plan view of an electric charge generator including a plurality of charge generation controlling devices arranged in a two-dimensional fashion according to the fifth embodiment. FIG. 14B is a cross-sectional view of FIG. 14A taken along line A–B. In FIGS. 14A and 14B, reference numeral 31 denotes a quartz (glass) substrate, and reference numeral 32 denotes a line electrode made of aluminum. Reference numeral 33 denotes a titanium thin film for preventing aluminum hillocks. Reference numeral 34 denotes a dielectric film of silicon oxide or silicon nitride having a thickness of a few μm formed by mean of plasma CVD (plasma chemical vapor deposition). Reference numeral 35 denotes a finger electrode wherein a high-melting point metal such as titanium or molybdenum is preferably employed as the material of the finger electrode so that the finger electrode can withstand the heat generation due to a corona discharge which occurs at the surface of the finger electrode. Since an AC bias voltage as high as about 1000 V is applied between the line electrode 32 and the finger electrode 35, it is required that the dielectric film 34 should have a high dielectric strength. The finger electrode 35 is connected to a finger pad 40 via a contact hole 42 formed in the dielectric film 34. Reference numeral 36 denotes an insulating film made of a resin having good heat resistance such as polyimide. Reference numeral 37 denotes a screen electrode formed either in a single layer structure using a metal material such as titanium, molybdenum, aluminum, or titanium nitride, or in a multi-layer structure consisting of some of the above-described metals. Reference numerals 38 anti 39 denote a finger hole and a screen hole, respectively.

Figure 15A:
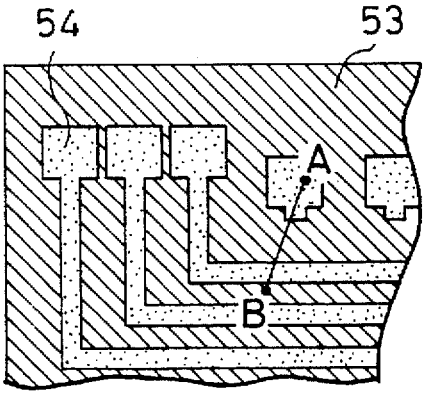
FIGS. 15A and 15B are a plan view and a cross-sectional view, respectively, illustrating a production process step of the electric charge generator of the fifth embodiment shown in FIGS. 14A and 14B.
Figure 15B:
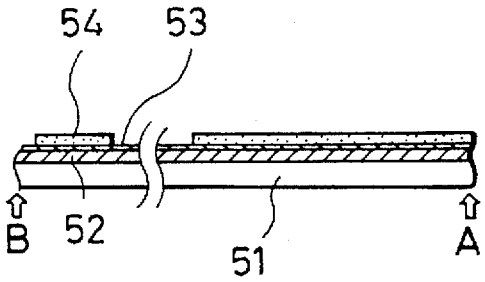
Figure 16A:
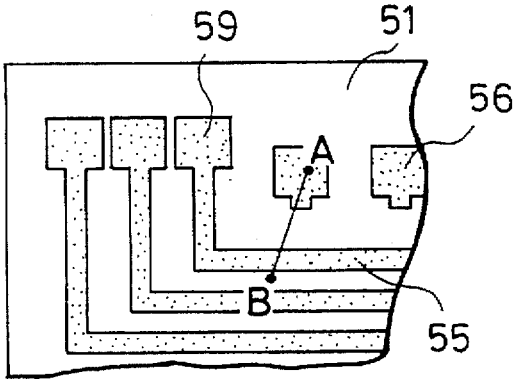
FIGS. 16A and 16B are a plan view and a cross-sectional view, respectively, illustrating the production process step following the step shown in FIGS. 15A and 15B.
Figure 16B:
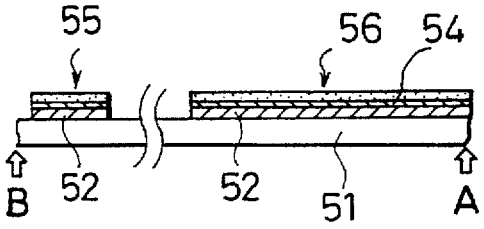

The production process flow of the electric charge generator according to the present embodiment will be described below. FIGS. 15A–19A are plan views illustrating the production process flow, wherein FIGS. 15B–19B are cross-sectional views of FIGS. 15A–19A taken along lines A–B. First, as shown in FIGS. 15A and 15B, an aluminum film 52 and then a titanium film 52 are deposited on a quarts (glass) substrate 51 by means of sputtering or vacuum evaporation. A resist pattern 54 is then formed on the surface of the titanium film 53. Then, as shown in FIGS. 16A and 16B, the portions, not covered with the resist pattern 54, of the aluminum film 52 and the titanium film 53 are etched away so as to form a line electrode 55, a line electrode pad 59, and a finger electrode pad 56.

Figure 1:
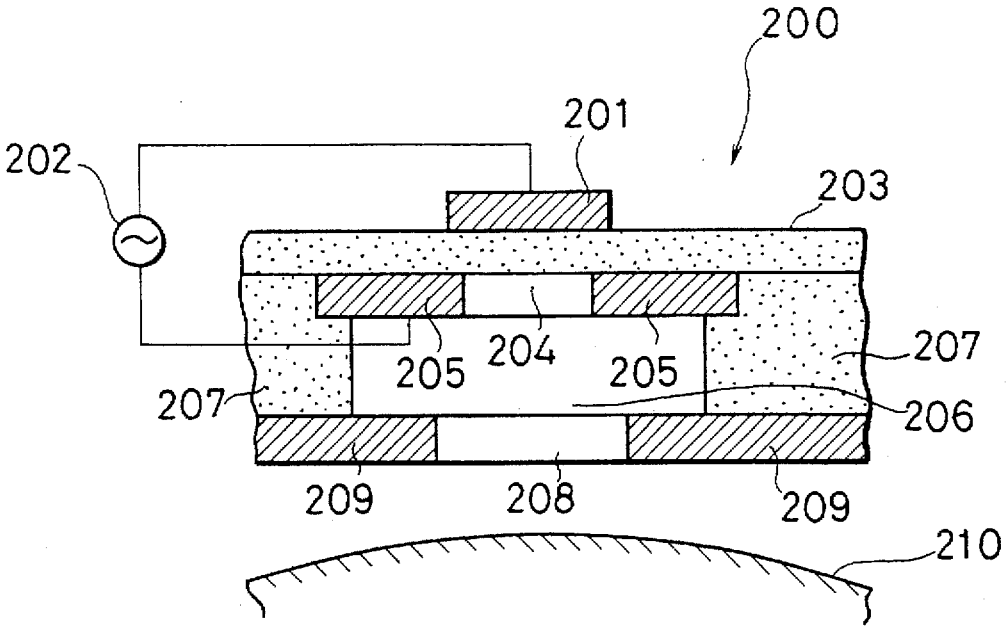
FIG.1 PRIOR ART
FIG. 1 is a cross-sectional view illustrating the structure of a conventional charge generation controlling device which is one of similar devices forming an electric charge generator for use in an apparatus for forming an electrostatic latent image.
Figure 2:
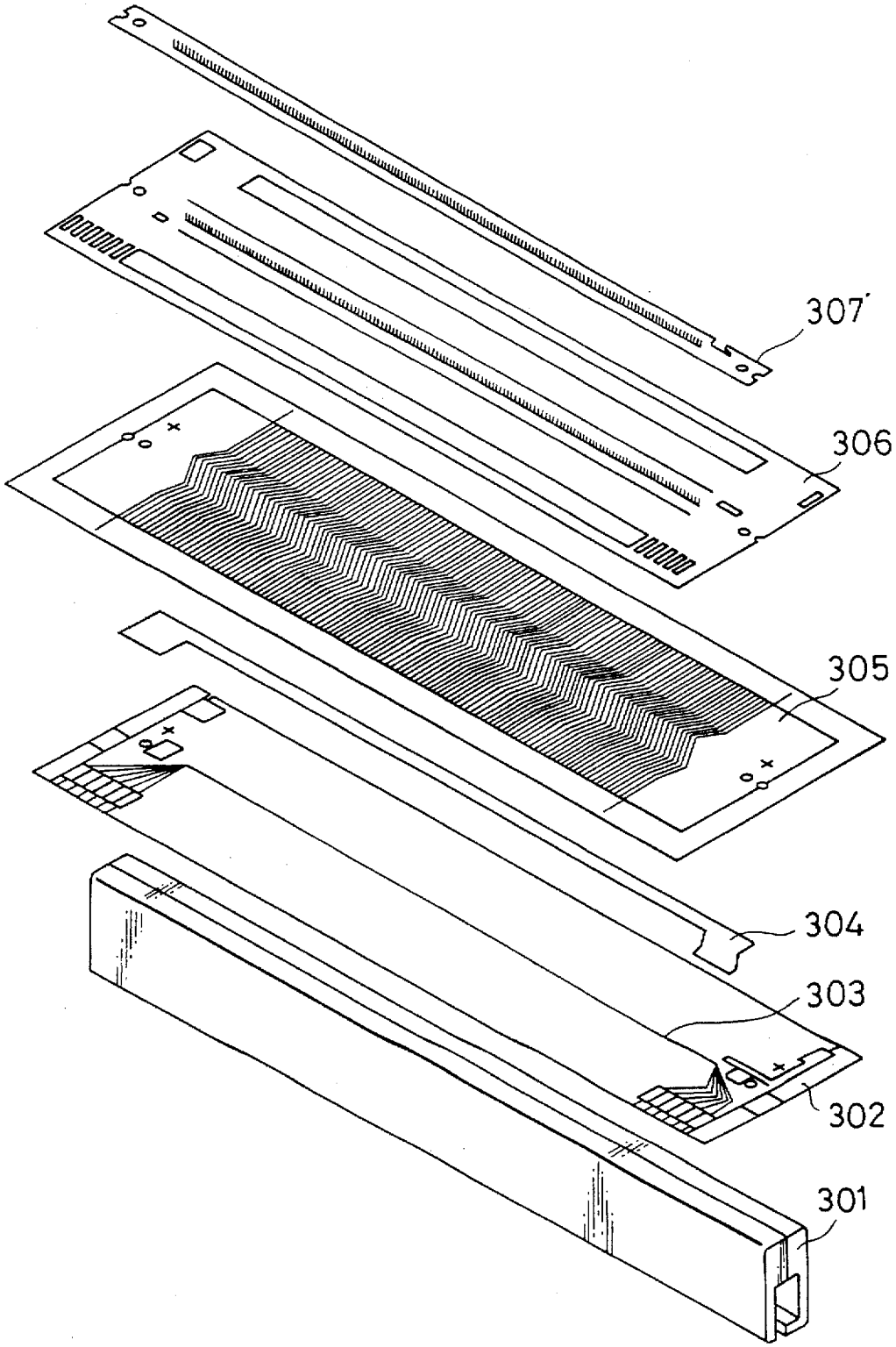
FIG. 2 PRIOR ART
FIG. 2 is a perspective view, in an exploded fashion, of a conventional electric charge generator for use in an apparatus for forming an electrostatic latent image.
Figure 17A:
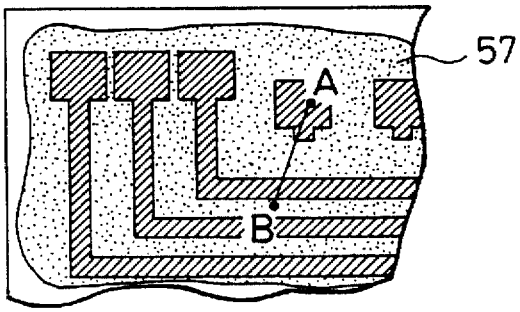
FIGS. 17A and 17B are a plan view and a cross-sectional view, respectively, illustrating the production process step following the step shown in FIGS. 16A and 16B.
Figure 17B:
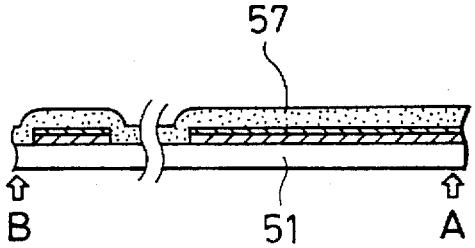

Then, as shown in FIGS. 1A and 17B, the resist pattern 54 is removed and a dielectric film 57 is deposited on the entire surface by means of for example plasma CVD.

Figure 18A:
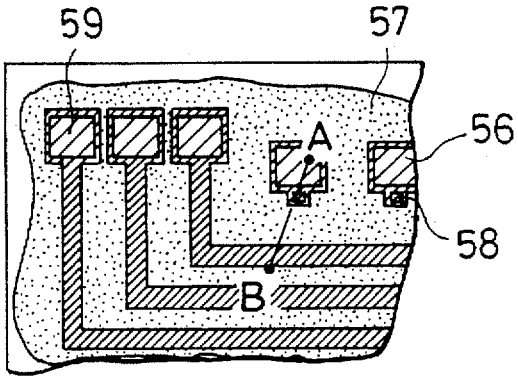
FIGS. 18A and 18B are a plan view and a cross-sectional view, respectively, illustrating the production process step following the step shown in FIGS. 17A and 17B.
Figure 18B:
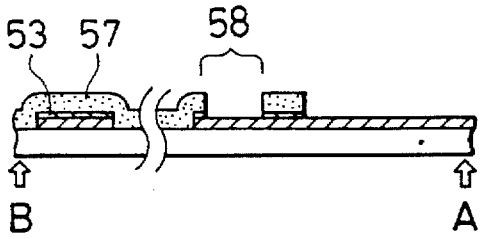
Figure 19A:
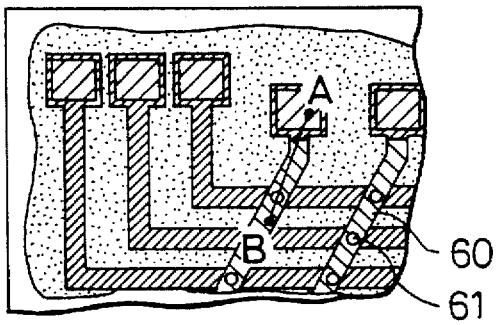
FIGS. 19A and 19B are a plan view and a cross-sectional view, respectively, illustrating the production process step following the step shown in FIGS. 18A and 18B.
Figure 19B:
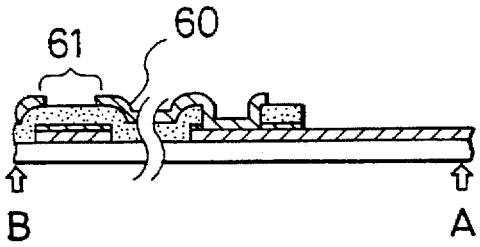

Then, as shown in FIGS. 18A and 18B, the dielectric film 57 and the titanium film 53 in the area above a contact area 58 between the finger electrode and the finger electrode pad 56, and also in the areas above the line electrode pad 59 and the finger electrode pad 56 is removed by means of etching. This etching process should be performed using a technique that allows the underlying aluminum not to be etched. A metal film such as molybdenum, titanium, or tungsten is deposited on the surface of the dielectric film 57, and then etched using a resist pattern as a mask as in the case of the line electrode 55 so that a finger electrode 60 having a finger hole 61 is formed as shown in FIGS. 19A and 19B. An insulating film 36 and then a screen electrode 37 are formed successively on the finger electrode 60 thereby obtaining a complete electric charge generator having the structure shown in FIGS. 15A and 14B. Not only aluminum but also other materials having a low electrical resistivity such as copper may also be employed as the material for the line electrode 55.

In this embodiment, the titanium film 33 serves to prevent aluminum hillocks from growing on the surface of the line electrode 32 during the process for forming the dielectric film 34. The aluminum hillocks are protrusions which are produced as a result of crystal growth of aluminum forming the line electrode 32. The aluminum hillocks can cause dielectric breakdown of the insulating film. Although, in the embodiment described above, titanium is employed as the material of the above-described protection film for preventing the growth of the aluminum hillocks, other hard materials such as molybdenum, tungsten, or titanium nitride may also be employed.

Furthermore, in the case where the line electrode is made up of only aluminum, if, after the formation of the line electrode, the surface of the line electrode is oxidized by means of hydration in water at about 80° C. and then heated at 450° C. or higher for a few ten minutes, an aluminum oxide film is formed at the surface of the line electrode. This aluminum oxide film may also be effective to prevent the growth of aluminum hillocks. Instead of forming a titanium film as the aluminum hillock protection film, it is also possible to prevent the growth of aluminum hillocks by depositing the dielectric film 34 at a temperature lower than 200° C.

In this embodiment, since the line electrode is made of aluminum, it is possible to obtain a very fine pattern using a microstructure fabrication technique widely used in the production of semiconductor devices. Furthermore, aluminum has a very low electric resistivity and thus the variation in impedance of the line electrodes becomes small. As a result, it is possible to improve the uniformity of the image reproduced by the electric charge generator. Furthermore, since a film having large hardness is formed on the surface of the line electrode, it is possible to prevent aluminum hillocks from growing on the surface of the line electrode during the process of fabricating the device. Therefore, even in the case where aluminum is employed as the material of the line electrode, it is possible to obtain a greatly improved dielectric strength between the line electrode and the finger electrode. All bonding pads of individual electrodes are made of aluminum regardless of the material of the electrodes. This ensures that when the electric charge generator is connected to another device via gold wires or the like, high reliability regarding the connection between the gold wires and the bonding pads is achieved regardless of the materials of the finger electrode and the aluminum hillock protection film.

Figure 20:
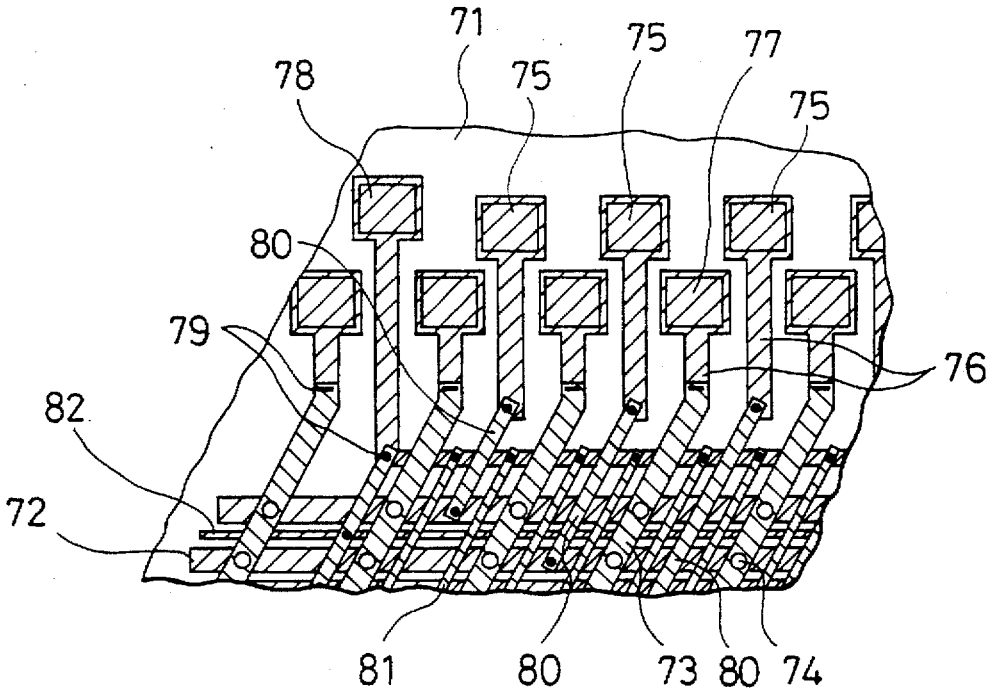
FIG. 20 is a plan view illustrating a part of an electric charge generator according to a sixth embodiment of the invention.

Now, a sixth embodiment will be described below. FIG. 20 is a plan view of an electric charge generator according to the sixth embodiment of the present invention. The construction of the electric charge generator of the sixth embodiment is basically the same as that of the fifth embodiment except that a line electrode 72 formed on a quartz (glass) substrate 71 is connected to a bonding pad 75 via an interconnection conductor 80. Since the interconnection conductor 80 is formed near a finger electrode 73, if a high voltage is applied to the interconnection conductor 80, the potentials of electrodes near the interconnection conductor 80 are disturbed, and thus an erroneous operation can occur. In the present embodiment, such the crosstalk between electrodes is avoided by disposing ground electrodes 81 and 82 between the interconnection conductor 80 and the finger electrode and between adjacent line electrodes 72. The ground electrode 82 and a ground electrode pad 78 are formed at the same time during the process of forming the line electrode 72, whereas the ground electrode 81 and the interconnection conductor 80 are formed at the same time during the process of forming the finger electrode 73. When a plurality of electric charge generators each including a plurality of charge generation controlling devices are combined into one unit so as to form a long electric charge generator, if electric charge generators having the structure according to the present embodiment are employed, then it is possible to connect the electric charge generators to each other without disturbing the arrangement of the charge generation controlling devices at the interface between adjacent electric charge generators. In FIG. 20, reference numeral 76 denotes interconnection conductors connected to the bonding pads 75 and 77. In the embodiment described above, the interconnection conductors 76 are formed in such a manner that they are integral with the bonding pads 75 and 77. However, it is also possible to form the interconnection conductors 76 separately from the bonding pads 75 and In the sixth embodiment shown in FIG. 20, the line electrode 72 is connected to the bonding pad 75 via one interconnection conductor 80. However, the line electrode 72 may also be connected to the bonding pad 75 via a plurality of interconnection conductors 80 and 76 as shown in FIG. 21.

Figure 21:
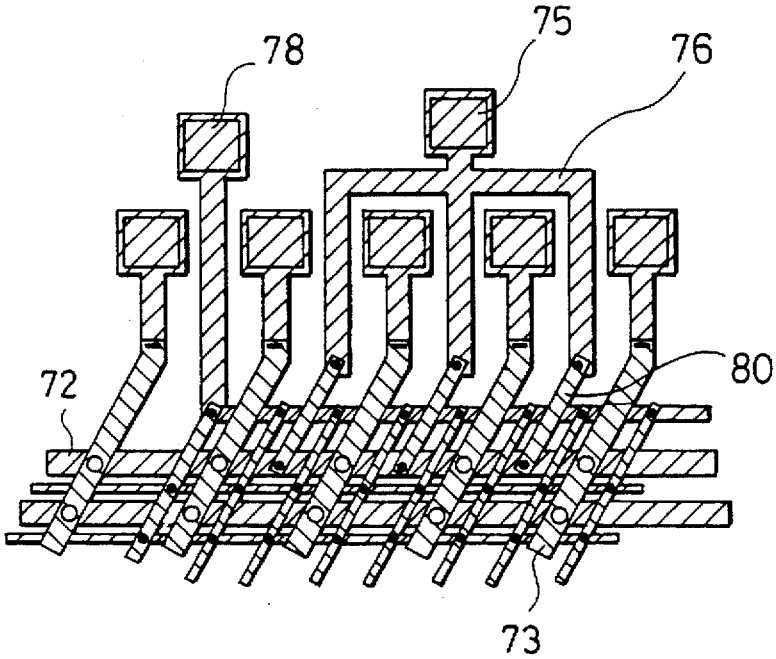
FIG. 21 is a plan view illustrating a modification of the sixth embodiment of the invention.
Figure 22:
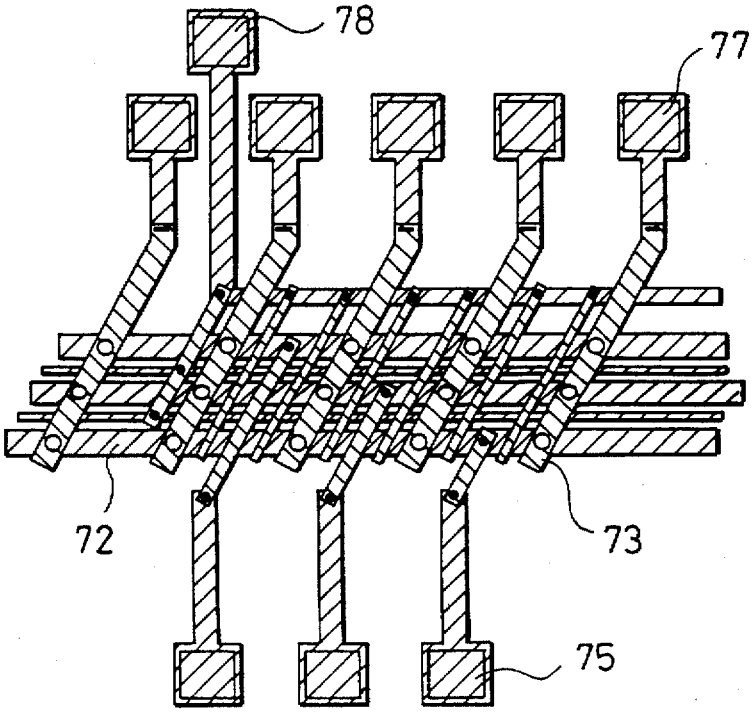
FIG. 22 is a plan view illustrating another modification of the sixth embodiment of the invention.

In either example shown in FIG. 20 or 21, all wire bonding pads 75, 77, and 78 are disposed on the same side. However, part of pads may also be disposed on the opposite side about the line electrode 72 as shown in FIG. 22. In this example, the bonding pads 77 for the finger electrode and the bonding pad 78 for the ground electrode are disposed on the upper side above the line electrode 72 in FIG. 22, and the bonding pads 75 for the line electrodes are disposed on the lower side.

This sixth embodiment makes it possible to combine a plurality of electric charge generators into one large electric charge generator. As the number of elements contained in an electric charge generator increases, the probability of including a bad element increases. Therefore, if one electric charge generator is divided into a plurality of small parts, and if good parts are combined into one unit, then it is possible to improve the overall production yield. Furthermore, even in the case where the finger electrode 73 and the bonding pad 77 are disposed far from each other, it is possible to effectively transfer the voltage applied to the bonding pad 77 to the finger electrode via the interconnection conductor 76 made up of aluminum having a low electrical resistivity.

Figure 23:
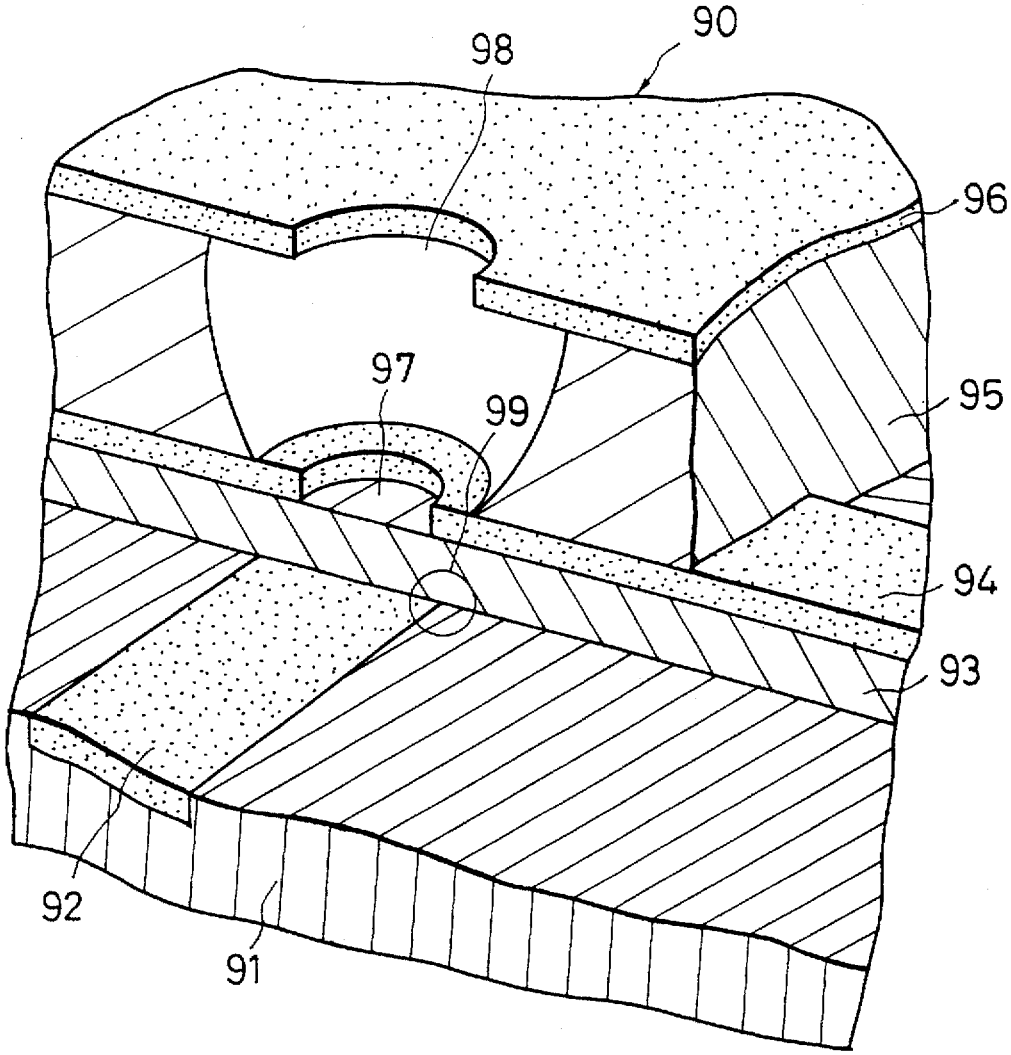
FIG. 23 is a perspective view in a partially cutaway fashion illustrating an electric charge generator according to a seventh embodiment of the present invention.

A seventh embodiment will be described below. FIG. 23 is a perspective view in a partially cutaway fashion illustrating an electric charge generator for use in an apparatus for forming an electrostatic latent image, according to the seventh embodiment of the present invention. In FIG. 23, reference numeral 90 denotes one charge generation controlling device wherein a complete electric charge generator is composed of a great number of charge generation controlling devices 90 arranged in a one-or two-dimensional fashion. The charge generation controlling device 90 includes: an insulating substrate 91 of quarts or glass; a line electrode 92 of metal; a dielectric film 93; a finger electrode 94 of metal; an insulating film 95; and a screen electrode 96, wherein the finger electrode 94 has a finger hole 97 and the screen electrode 96 has a screen hole 98. The line electrode 92 is embedded in the insulating substrate 91.

The embedding of the line electrode 92 into the insulating substrate 91 eliminates the steps at the edges 99 of the line electrode 92. As a result, there occurs no reduction in thickness of the dielectric film 93 that would otherwise occur above the stepped portion of the line electrode 92. This allows a great improvement of the withstand voltage characteristic of the dielectric film.

Figure 24:
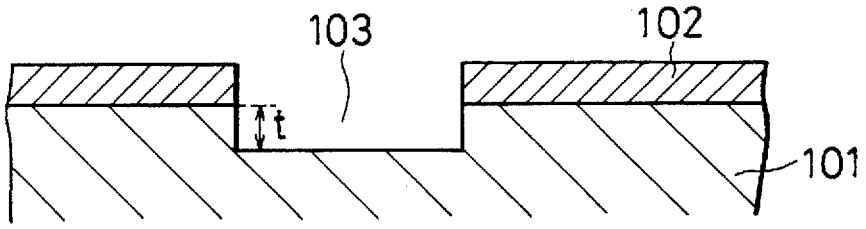
FIG. 24 is a schematic diagram illustrating a production process step of an electric charge generator of the seventh embodiment of the invention.

Referring to FIGS. 24–28, the production process flow of the charge generation controlling device of the electric charge generator according to the present embodiment will be described below. First, a resist pattern 102 is formed on a quartz (glass) substrate 101 so that the entire surface of the substrate 101 other than the area on which a line electrode is to be formed is covered with the resist pattern 102 as shown in FIG. 24. The substrate 101 is then etched either isotropically or anisotropically so that a recess 103 having a depth equal to the thickness of the line electrode is formed in the area of the substrate not covered with the resist pattern 102. The depth t of the recess 103 is preferably in the range from 0.5 μm to 5.0 μm.

Figure 25:
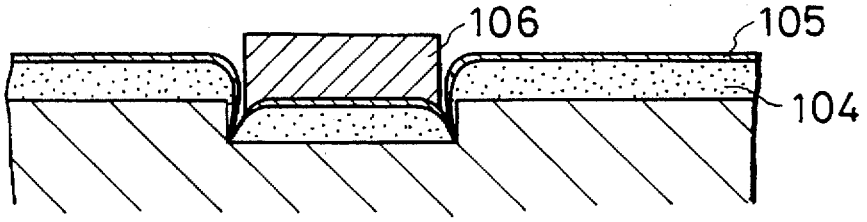
FIG. 25 is a schematic diagram illustrating the production process step following the step shown in FIG. 24.
Figure 26:
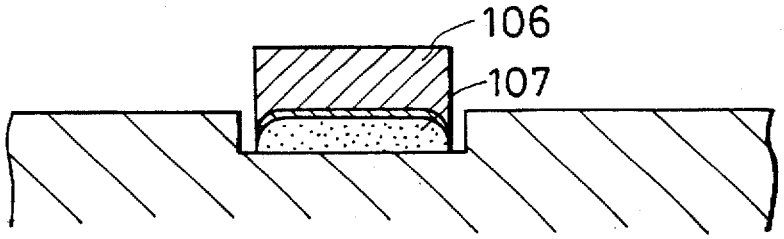
FIG. 26 is a schematic diagram illustrating the production process step following the step shown in FIG. 25.

Then, as shown in FIG. 25, the resist pattern 102 is removed and an aluminum film 104 and then a titanium film 105 are deposited successively by means of sputtering or vacuum evaporation. A resist pattern 106 is then formed on the part where the aluminum film 104 and the titanium film 105 are disposed in the recess 103. The titanium film 105 is used as the hillock barrier against the aluminum film 104. Then, as shown in FIG. 26, the portions, not covered with the resist pattern 106, of the aluminum film 104 and the titanium film 105 are removed by means of either isotropic or anisotropic etching so as to form a line electrode 107.

Figure 27:
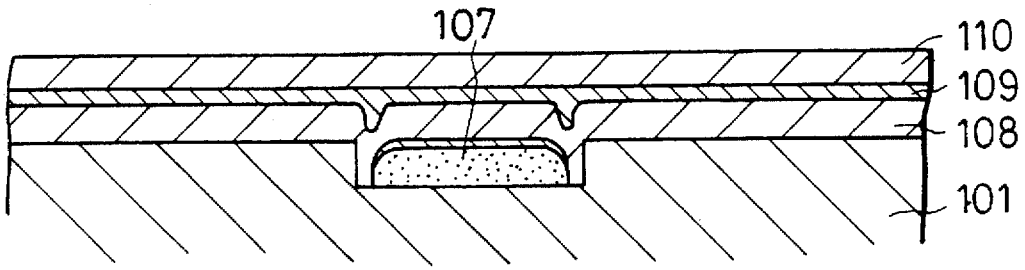
FIG. 27 is a schematic diagram illustrating the production process step following the step shown in FIG. 26.
Figure 28:
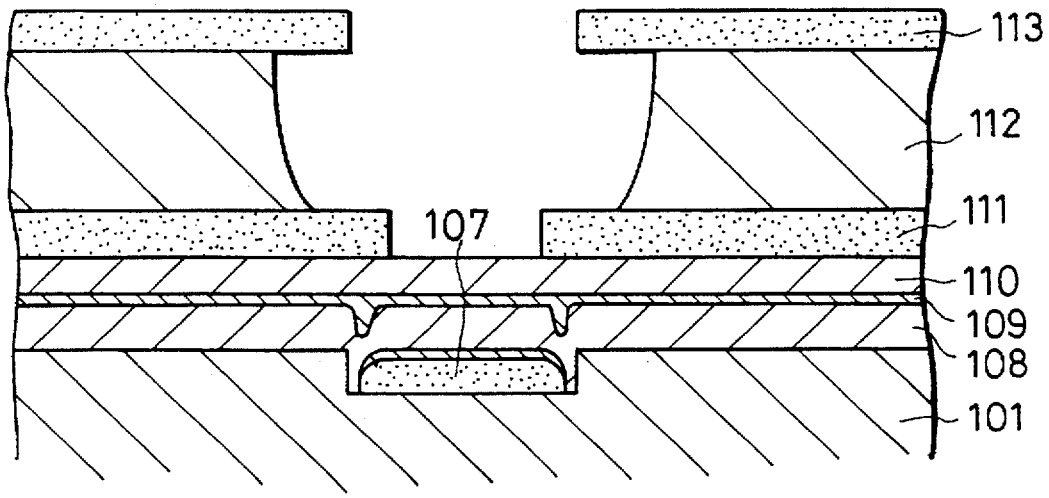
FIG. 28 is a schematic diagram illustrating the production process step following the step shown in FIG. 27.

Afterward, as shown in FIG. 27, the resist pattern 106 is removed and then a silicon oxide film 108 is deposited by means of for example plasma CVD. Then an SOG (spin-on-glass) film 109 is further formed thereon so that the spaces between the edges of the line electrode 107 and the walls of the recess 103 are filled with the SOG film thereby obtaining a planarized surface. A silicon oxide film 110 is then formed thereon by means of for example plasma CVD. These films including the silicon oxide film 108, the SOG film 109, and the silicon oxide film 110 form the dielectric film. Then, as shown in FIG. 28, a finger electrode 111, an insulating film 112, and a screen electrode 113 are successively formed on the silicon oxide film 110. Thus, a complete electric charge generator is obtained.

It is preferable that the width of the resist pattern 106 be 1 to 2 μm smaller than the width of the recess 103 so as to obtain well-defined edges of the line electrode 107. Furthermore, if a part of or the whole of the silicon oxide 108 is formed at a temperature lower than 200 ° C., it is not required to form a titanium film 105, for preventing the growth of hillocks, on the surface of the aluminum film 104. In the embodiment described above, aluminum is employed as the material for the line electrode. Alternatively, other materials such as copper, molybdenum, or tungsten may also be employed. However, it is preferable that the material employed have a low resistivity less than $1\times10^{-5}$ Ωcm.

Furthermore, in the embodiment described above, titanium is employed as the material of the film for preventing the growth of the aluminum hillocks, other materials having hardness high enough to prevent the hillocks, such as titanium nitride, molybdenum also be employed. Furthermore, although a multilayer film consisting of a silicon oxide film and an SOG film is employed as the dielectric film in the embodiment described above, various multilayer films having a high dielectric strength such as a single layer of a silicon nitride or a TEOS (tetraethoxysilane) film plus an SOG film, or a multilayer film of silicon oxide, silicon nitride, and TEOS plus an SOG film may also be employed. It should be noted here that the thickness of the line electrode 107 should preferably be nearly equal to the depth t of the recess 103 shown in FIG. 24 so as to optimizing the planarization.

In the charge generation controlling device produced according to the production technique described above, since the line electrode 107 is embedded in the insulating substrate 101, it is possible to fully planarize the surface of the underlying layer on which a dielectric film consisting of a silicon oxide films 108 and 110 and an SOG film 109 is to be formed. As a result of the above-described planarization, there is no steps at edges of the line electrode 107. This allows a great improvement of the durability of the dielectric film. The above production technique makes it possible to fully planarize the underlying layer on which the dielectric film is to be formed without making a great modification in the production process except the addition of one photomask. If the recess is formed using a resist having an opposite optical sensitivity to that of the resist used to form the line electrode (for example a negative resist may be employed for forming the recess if a positive resist is used for the line electrode), the same photomask as that used to form the line electrode may also be used to form the recess and thus it is not required to make an additional photomask.

Figure 29A:
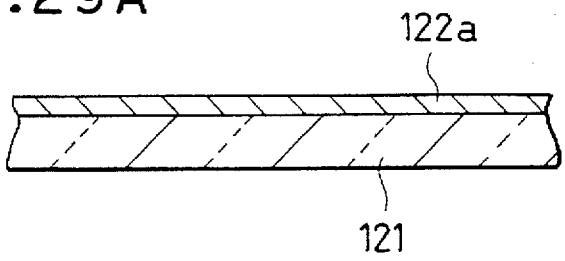
FIGS. 29A–29H are schematic diagrams illustrating the production process steps for producing the electric charge generator according to an eighth embodiment of the invention.
Figure 29B:
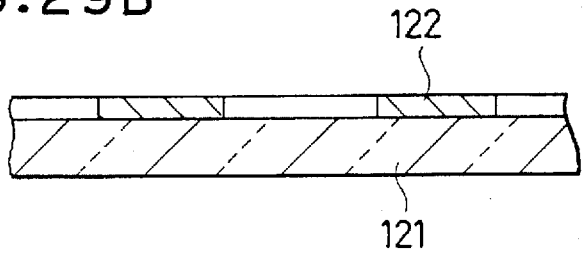
Figure 29C:
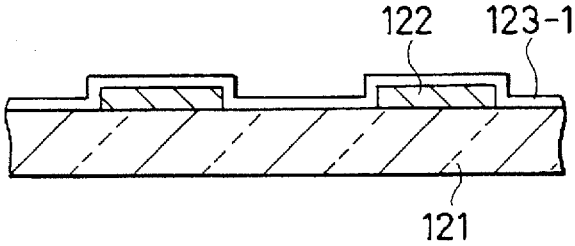
Figure 29D:
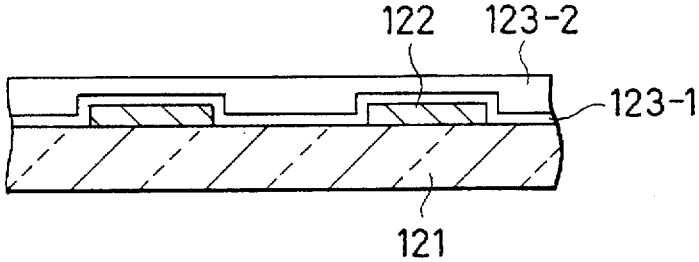

Referring to FIGS. 29A–29H, the production process flow according to an eighth embodiment of the present invention will be described below. An electric charge generator of the present embodiment is produced according to the production processing steps described below. First, as shown in FIG. 29A, a thin aluminum film **122*a* is deposited on a glass substrate 121 by means of sputtering. The thin aluminum film 122*a* is etched into a desired pattern thereby forming a line electrode 122 as shown in FIG. 29B. Then, as shown in FIG. 296, a first dielectric film 123-1 of silicon oxide Si02 is deposited by means of plasma polymerization so that the surface of the line electrodes 122 and the surface of the glass substrate 121 exposed between adjacent line electrodes 122 are covered with the first dielectric film 123-1. Then, as shown in FIG. 29D, a planarized layer 123-2 of coated glass is formed thereon. The planarizing layer 123-2 is formed as follows: A coated-glass material dissolved in an organic solvent is coated by means of a spin coating technique so that the recessed portions of the surface structure of the first dielectric film 123-1** are filled with the coated film thereby achieving a flat surface. Then, the coated film is dried and cured.

Figure 29E:
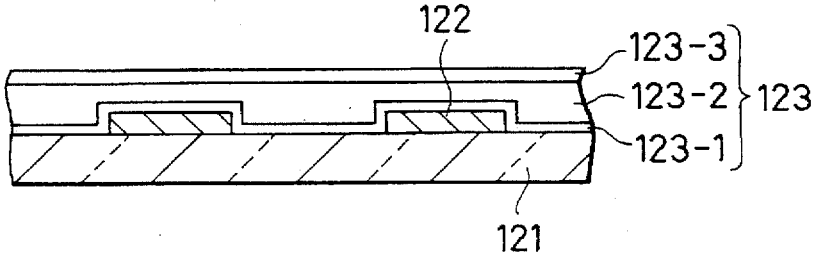
Figure 29F:
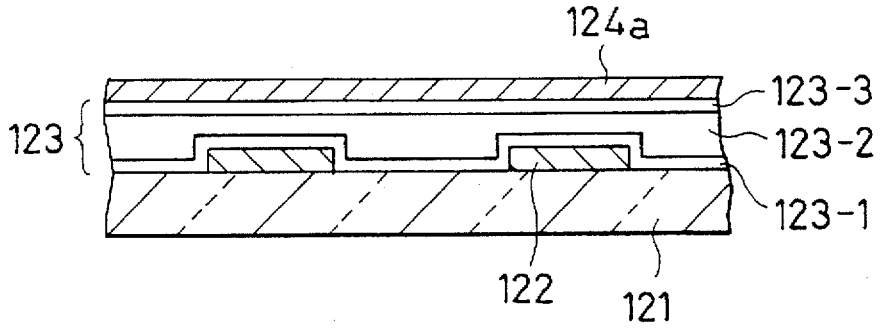
Figure 29G:
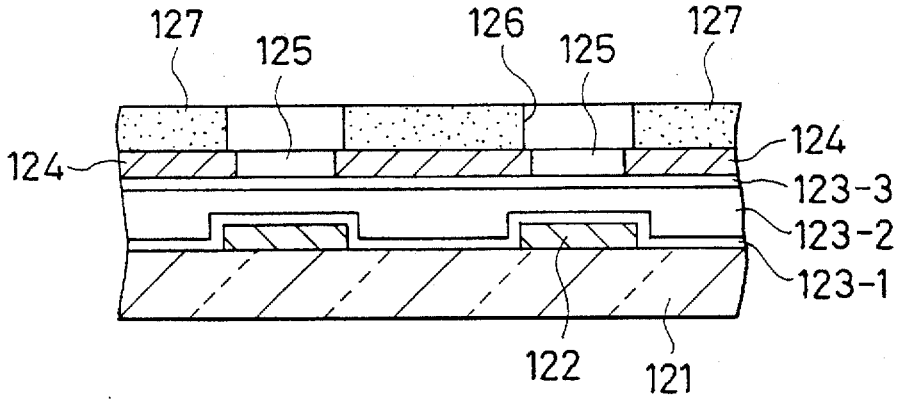

Furthermore, as shown in FIG. 29E, a second dielectric film 123-3 is formed on the planarizing layer 123-2 in the same manner as in the first dielectric film 123-1. Thus, a dielectric layer 123 having a three-layer structure is obtained. Then, as shown in FIG. 29F, a thin molybdenum film **124*a* is formed by means of sputtering. Furthermore, as shown in FIG. 29G, the thin molybdenum film 124*a* is etched into a desired pattern thereby forming a finger electrode 124. During the above process step, openings 125 are also formed in the finger electrode 124**.

Figure 29H:
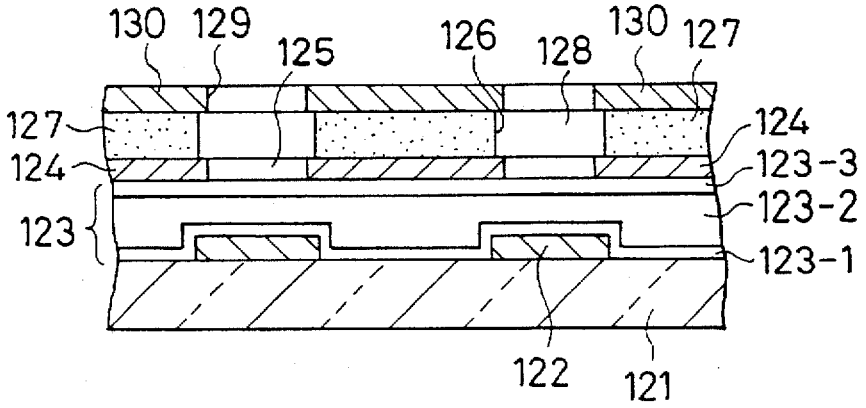

A polyimide layer having a uniform thickness is then coated on the finger electrode 124 by means of a spin coating technique. A transmission hole 126 for passing an electric charge is formed in the polyimide layer by means of etching thereby forming an insulating layer 127 of polyimide. Then, as shown in FIG. 29H, after tile transmission hole 126 of the insulating layer 127 and the openings 125 of the finger electrode 124 are filled with a liquid resist material 128, a thin molybdenum film is deposited by means of sputtering. After that, the thin molybdenum film is etched into a desired pattern thereby forming a screen electrode 130 having openings 129 for ejecting an electric charge. Finally, the liquid resist material 128 in the transmission holes 126 of the insulating layer 127 and the openings 125 of the finger electrode 124 is removed through the openings 129 of the screen electrode. Thus, the production of the electric charge generator of the present embodiment is completed.

The preferable thicknesses of the electrodes 122, 124, and 130, the dielectric layer 123, and the insulating layer 127 are as follows. That is, the thickness of the line electrode 122 is 1.22 μm, the thicknesses of the finger electrode 124 and the screen electrode 130 are 3 μm, and the thickness of the insulating layer 127 is 30 μm. The dielectric layer 123 is composed of: the first dielectric film 123-1 having a dielectric constant of 3.8 and a thickness of 0.6 μm; the planarizing layer 123-2 having a dielectric constant of 3.1 and a thickness of 1 μm; and the second dielectric film 123-3 having a dielectric constant of 3.8 and a thickness of 0.8 μm. Therefore, the total thickness of the dielectric layer 123 is 2.4 μm. The openings 125 and 129 of the finger electrode 124 and the screen electrode 130 are both formed in a circular shape with a diameter of 60 μm. The diameter of the transmission hole 126 formed in the insulating layer 127 is 80 μm.

Figure 30:
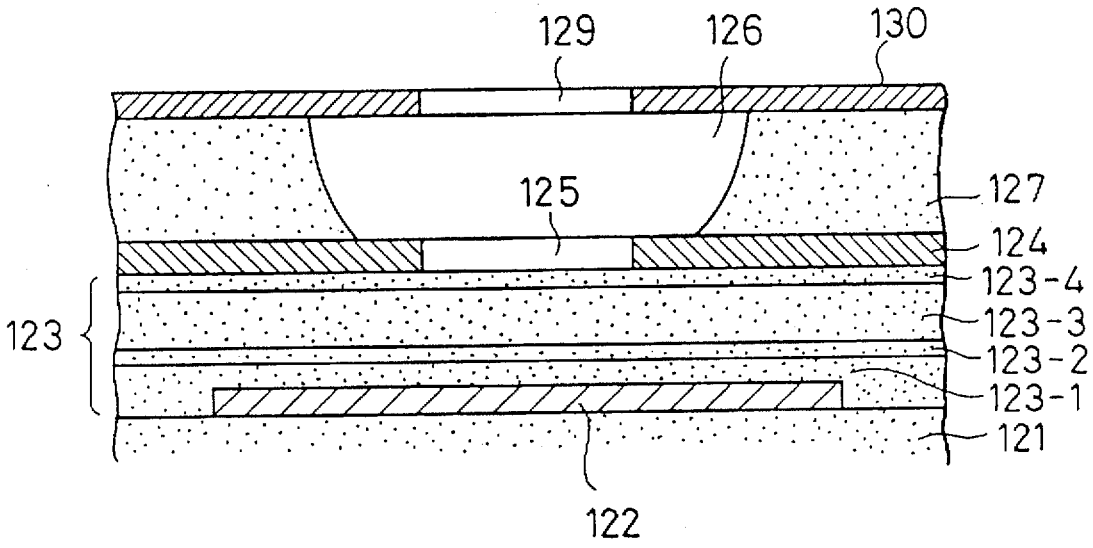
FIG. 30 is a cross-sectional view illustrating a ninth embodiment of the invention.

Now, a ninth embodiment will be described below. FIG. 30 is a schematic view illustrating the cross-sectional structure of a charge generation controlling device forming an electric charge generator according to the ninth embodiment of the invention, wherein like parts corresponding to those in the eighth embodiment shown in FIGS. 29A–29H are denoted by the same reference and will not be described herein again. This ninth embodiment is characterized in that the second dielectric film 123-3 in the eighth embodiment is, in this embodiment, covered with a third dielectric film 123-4 of a material different from that of the dielectric film 123-3 so that the dielectric layer 123 having a four-layer structure is disposed between the line electrode 122 and the finger electrode 124. For example, if the material of the first and second dielectric films 123-1 and 123-3 is $SiO_2$, SiN or otherwise alumina or tantalum oxide which will be described later in the tenth embodiment may preferably be employed as the material of the third dielectric film 123-4.

The charge generation controlling device of the ninth embodiment is produced in the same manner as in the eighth embodiment until the second dielectric film 123-3 shown in FIG. 30 has been formed. After the formation of the second dielectric film 123-3, a third dielectric film 123-4 is deposited on the second dielectric film 123-3 by means of plasma CVD or atmospheric-pressure CVD. The thickness of the third dielectric film 123-4 is preferably in the range from 0.1 μm to 1.0 μm. A contact hole for the line electrode pad is then formed as follows: First, a resist pattern is formed by means of photolithography. Then, the dielectric film is etched by means of wet etching or dry etching, or otherwise a combination of wet etching and dry etching.

In this ninth embodiment, since the third dielectric film having high durability with a thickness of 0.1 μm to 1.0 μm is further deposited on the second dielectric film of the dielectric layer of the eighth embodiment, the durability of the dielectric film is further improved.

When an electric charge generation controlling device forming an electric charge generator is driven, a high electric field such as a few MV/cm appears in the dielectric film. Furthermore, the surface of the dielectric film is exposed to a plasma generated by a corona discharge, and thus the surface is eroded. To resolve the above problems and thus improve the reliability, it is required to increase the thickness of the dielectric film and/or employ an insulating film hard enough to withstand the corona discharge. However, if an insulating film which has perfect hardness to withstand the corona discharge is employed as the material of the dielectric film, the deposition of the film as well as the processing thereof requires a long time. Besides, such a film causes additional problems such as cracking due to the stress in the film, bowing of the insulating substrate, and an increase in the discharge starting voltage. In the ninth embodiment, although the above problems are greatly alleviated by forming an insulating film which can withstand the corona discharge on the entire surface of the dielectric film, it is difficult to avoid the problems of cracking due to the film stress and bowing of the insulating substrate. The above problems will be solved by the tenth embodiment described below.

Figure 31:
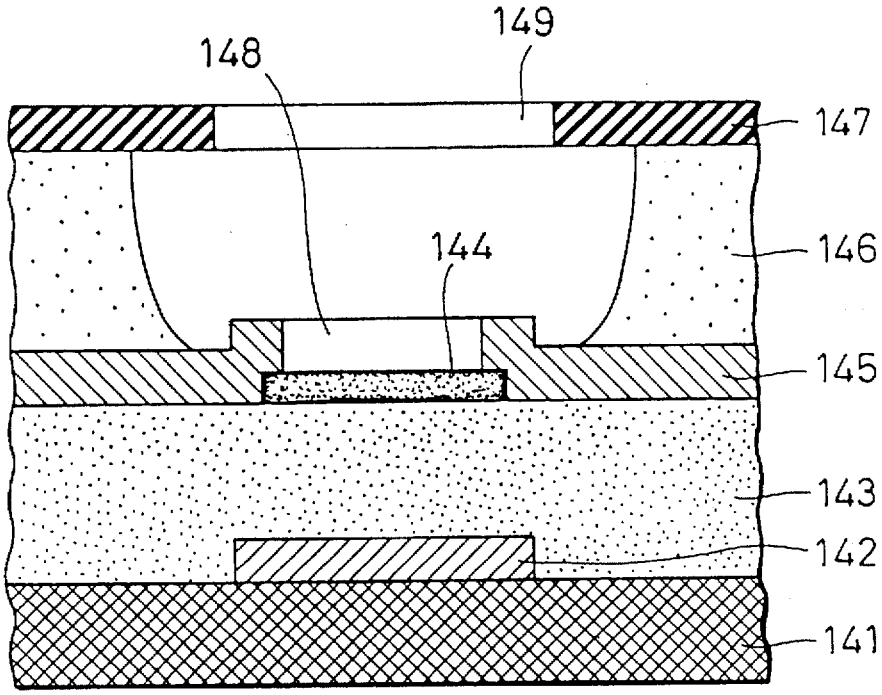
FIG. 31 is a schematic diagram illustrating the cross-sectional structure of a charge generation controlling device of an electric charge generator according to a tenth embodiment of the invention.

The tenth embodiment will be described below. FIG. 31 is a cross-sectional view of a charge generation controlling device of the tenth embodiment. In FIG. 31, reference numeral 141 denotes an insulating substrate made of a quarts, glass, or alumina. Reference numeral 142 denotes a line electrode of metal formed on the insulating substrate 141. Reference numeral 143 denotes a dielectric film formed on the insulating substrate 141 and the line electrode 142. Reference numeral 145 denotes a finger electrode having a finger hole 148 in its central part wherein the finger electrode is formed on the dielectric film 143. Reference numeral 144 denotes a protective insulating film which is formed on the surface of the dielectric film 143 in such a manner that the location of the protective insulating film 144 corresponds to the finger hole 148 of the finger electrode 145 wherein the formation of the protective insulating film 144 is performed before the formation of the finger electrode 145. The protective insulating film 145 is formed of a material which is denser and harder than the dielectric film 143. The peripheral portion of the protective insulating film 145 is sandwiched between the dielectric film 143 and the finger electrode 145. Reference numeral 146 denotes an insulating film having a charge transmission hole formed in the central part thereof. Reference numeral 147 denotes a screen electrode formed on the surface of the insulating film 146 wherein the screen electrode 147 has a screen hole 149 in its central part so that charge can pass through the screen hole 149.

In the charge generation controlling device having the structure described above, the surface of the dielectric film 143 in the area within the finger hole 148 is covered with the protective insulating film 144 which is dense and hard so as to reinforce the dielectric film 143 and prevent the dielectric film 143 from the erosion due to a corona discharge occurring in the finger hole 148. Thus, the dielectric film 143 obtains excellent durability. Since the protective insulating film 144 is selectively formed only in the area corresponding to the finger hole 148, cracking in the dielectric film 143 and bowing of the insulating substrate 141 are effectively prevented.

Figure 32A:
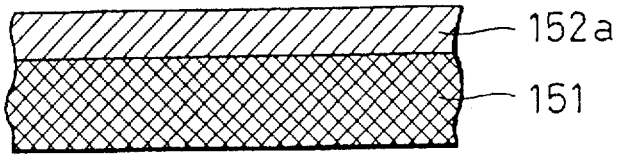
FIGS. 32A–32H are schematic diagrams illustrating the production process steps for producing the electric charge generator according to the tenth embodiment of the invention.
Figure 32B:
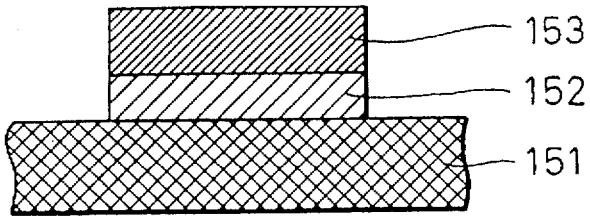
Figure 32C:
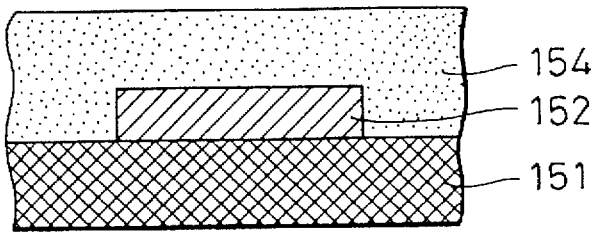

Referring to FIGS. 32A–32H, the production process flow of the charge generation controlling device of the tenth embodiment shown in FIG. 31 will be described below. First, a titanium film **152*a* having a thickness of about 0.5 μm for use as the line electrode is formed on a substrate 151 of quartz (or glass or alumina) as shown in FIG. 32A. Then, as shown in FIG. 32B, a resist pattern 153 is formed on the titanium film 152*a* and the portion of the titanium film 152*a* not covered by the resist pattern 153 is removed by means of either isotropic etching or anisotropic etching so that a line electrode 152 is formed. Then, as shown in FIG. 32C, after removing the resist pattern 153, a silicon oxide film 154 is formed by means of for example the reaction between silane ($SiH_4$) and nitrogen monoxide ($N_2O$) using for example a plasma CVD technique. To withstand a high voltage applied between the line electrode and a finger electrode described later, the silicon oxide film 154** has a preferable thickness in the range from 3 μm to 6 μm.

Figure 32D:
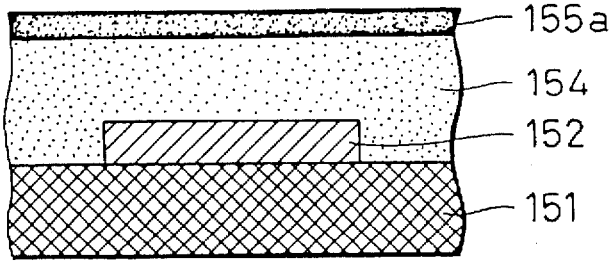
Figure 32E:
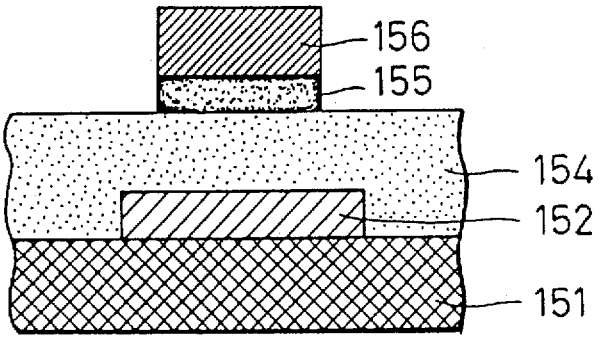

Then, as shown in FIG. 32D, a silicon nitride film **155*a* having a thickness of about 1 μm is formed by means of for example the reaction between silane (SiH4) and ammonia ($NH_3$) using for example a plasma CVD technique. Judging from the etching rate and the hardness of the films, it is apparent that the silicon nitride film is denser and harder than the silicon oxide film, and the silicon nitride film 155*a* has excellent a resistance property against the corona discharge. Then, as shown in FIG. 32E, a resist pattern 156, having a size which is about 1 μm greater than the size of a finger hole described later, is formed on the silicon nitride film 155***a*, and the portion of the silicon nitride film not covered by the resist pattern 156 is removed by means of either isotropic etching or anisotropic etching so that a protective insulating film 155 of silicon nitride harder than the dielectric film 154 is selectively formed in the area corresponding to the finger hole.

Figure 32F:
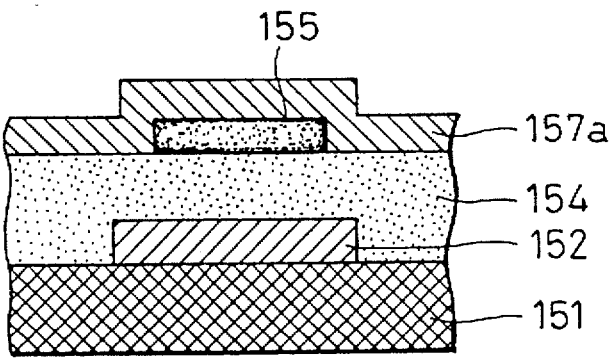
Figure 32G:
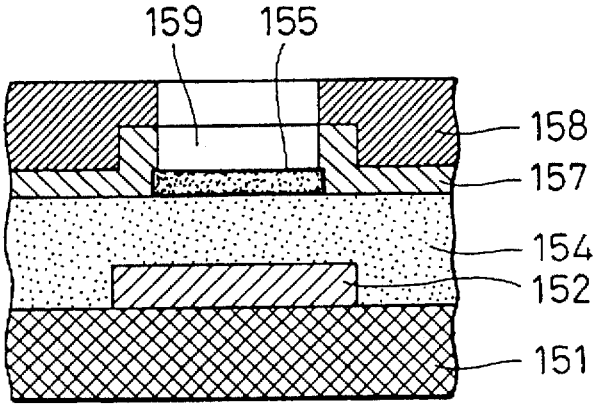
Figure 32H:
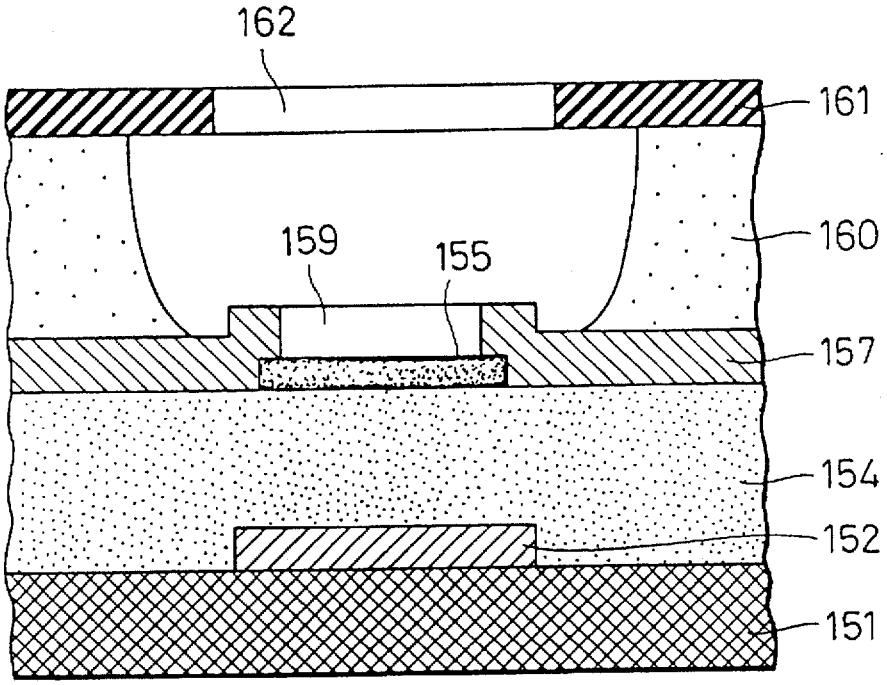

Furthermore, as shown in FIG. 32F, after removing the resist pattern 156, a titanium film 157*a* having a thickness of about 1 μm, for use as a finger electrode, is deposited on the entire surface by means of for example sputtering. Then, as shown in FIG. 32G, a finger hole pattern is formed in a resist 158, and the titanium film 157*a* is selectively removed by means of either isotropic etching or anisotropic etching so that a titanium finger electrode 157 having a finger hole 159 is formed. Then, as shown in FIG. 32H, after removing the resist 158, an insulating film 160 having a charge transmission hole in the central part thereof is formed of a material having good heat resistance such as polyimide, and subsequently a screen electrode 161 having a screen hole 162 is formed. Thus, a complete charge generation controlling device having the structure shown in FIG. 31 is obtained.

Although titanium is employed as the material for the line electrode in the embodiment described above, other materials having a relatively low resistivity such as aluminum, copper, molybdenum, or tungsten may also be employed. As for the dielectric film, in addition to silicon oxide employed in the above embodiment, other materials such as a silicon oxide film doped with impurities such as phosphorus (P), or boron (B), or otherwise an SOG (spin-on-glass) film may also be employed.

Furthermore, in the embodiment described above, although a silicon nitride film formed using a plasma CVD technique is employed as the protective insulating film having properties different form those of the dielectric film, other insulating materials such as alumina ($A1_2O_3$), tantalum oxide ($Ta_2P_5$), magnesium oxide (MgO), titanium oxide ($TiO_2$), boron nitride (BN), phosphorus pentaoxide ($P_2O_5$), boron oxide ($B_2O_3$), lead oxide (PbO), aluminosilicate glass ($A1_6Si_2O_{13}$), diamond-like carbon (DLC), zinc oxide ($ZnO_2$), zirconium oxide ($ZrO_2$)., calcium fluoride ($CaF_2$), or silicon carbide (SIC) may also be employed.

Among the above, if alumina is employed, as the material, the protective insulating film can be formed as follows. Three techniques for forming an alumina film are known. Those are CVD, PVD (physical vapor deposition), and oxidation. In the case of the CVD, an alumina film is formed by pyrolyrically decomposing triethoxyaluminum [Al($OC_2H_5$)3] or trimethoxyaluminum [Al($OCH_3$)3] at about 350 ° C., or otherwise by means of reaction between trimethyl aluminum [Al($CH_3$)3] and oxygen ($O_2$) at about 350 ° C. Then the alumina film is subjected to heat treatment at about 800 ° C. so that undecomposed products contained in the film are removed thereby enhancing the crystallization of the alumina film and thus obtaining a hard film.

According to the production technique described above, the protective insulating film consisting of a hard and dense insulating film such as silicon nitride or alumina is selectively formed only in the region inside the finger hole 159 exposed to a corona discharge. As a result, not only the erosion of the dielectric film due 1zo the corona discharge is prevented, but also cracking of the dielectric film and bowing of the insulating substrate are prevented, and thus the durability is greatly improved.

Figure 33A:
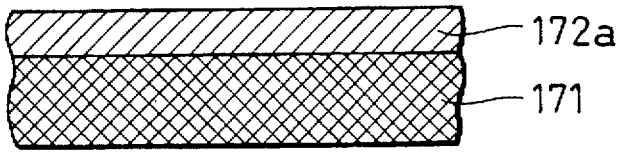
FIGS. 33A–33H are schematic diagrams illustrating the production process steps for producing an electric charge generator according to an eleventh embodiment of the invention.
Figure 33B:
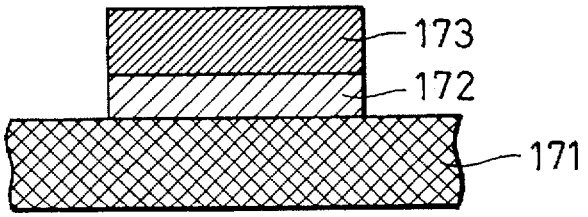
Figure 33C:
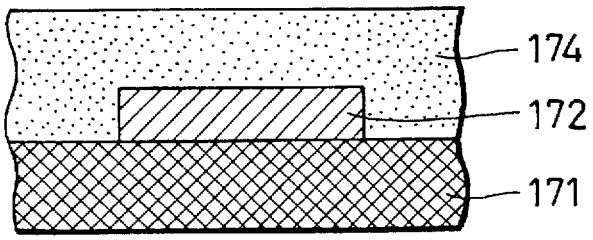

Referring to FIGS. 33A–33H, the production process flow according to an eleventh embodiment of the invention will be described below. First, as shown in FIG. 33A, a titanium film 172*a* having a thickness of about 0.5 μm, to be used as the line electrode, is deposited on a quartz (glass) substrate 171 by means of for example sputtering, as in the production process in the tenth embodiment. Then, as shown in FIG. 33B, a resist pattern 173 is formed, and the portion of the titanium film 172*a* not covered by the resist pattern 173 is removed by means of either isotropic or anisotropic etching thereby forming a line electrode 172. Furthermore, as shown in FIG. 33C, after removing the resist pattern 173, a dielectric film 174 of silicon oxide is deposited on the entire surface by means of for example plasma CVD. To withstand a high voltage applied between the line electrode 172 and a finger electrode described later, it is preferable that the thickness of the dielectric film 174 be in the range from 3 μm to 6 μm.

Figure 33D:
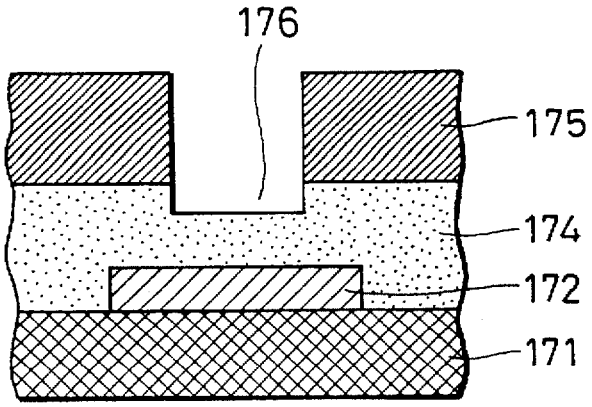
Figure 33E:
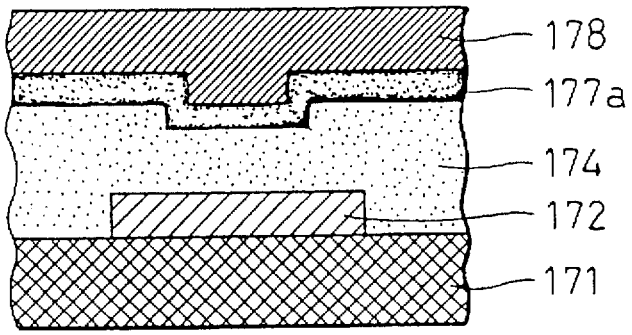
Figure 33F:
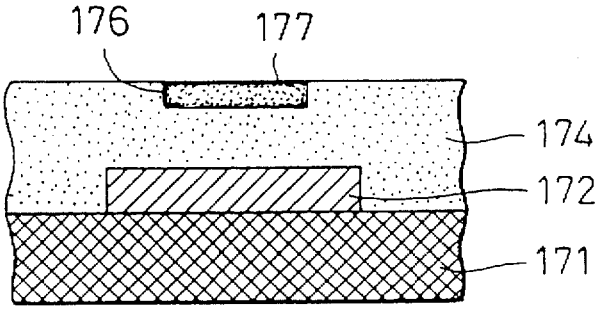

Then, as shown in FIG. 33D, a resist pattern 175, having a size which is about 1 μm greater than the size of a finger hole described later, is formed on the dielectric film 174, and the portion of the dielectric film 174 not covered by the resist pattern 175 is etched by about 1 μm by means of either isotropic or anisotropic etching so that a recess 176 is formed on the dielectric film 174. Then as shown in FIG. 33E, after removing the resist pattern 175, a silicon nitride film 177*a* serving as a protective insulating film is formed by means of for example plasma CVD. A resist 178 is then coated on the entire surface of the silicon nitride film 177*a*. Anisotropic etching is then performed using for example a mixture gas of carbon tetrafluoride ($CF_4$) and oxygen ($O_2$) so that the dielectric film 174 becomes exposed except the recess portion as shown in FIG. 33F. Thus, a protective insulating film 177 of silicon nitride is formed inside the recess 176.

Figure 33G:
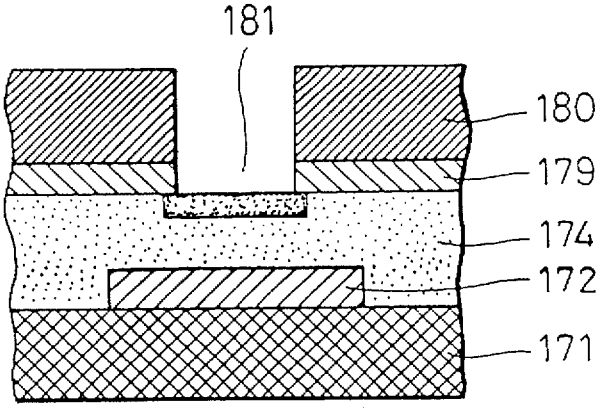
Figure 33H:
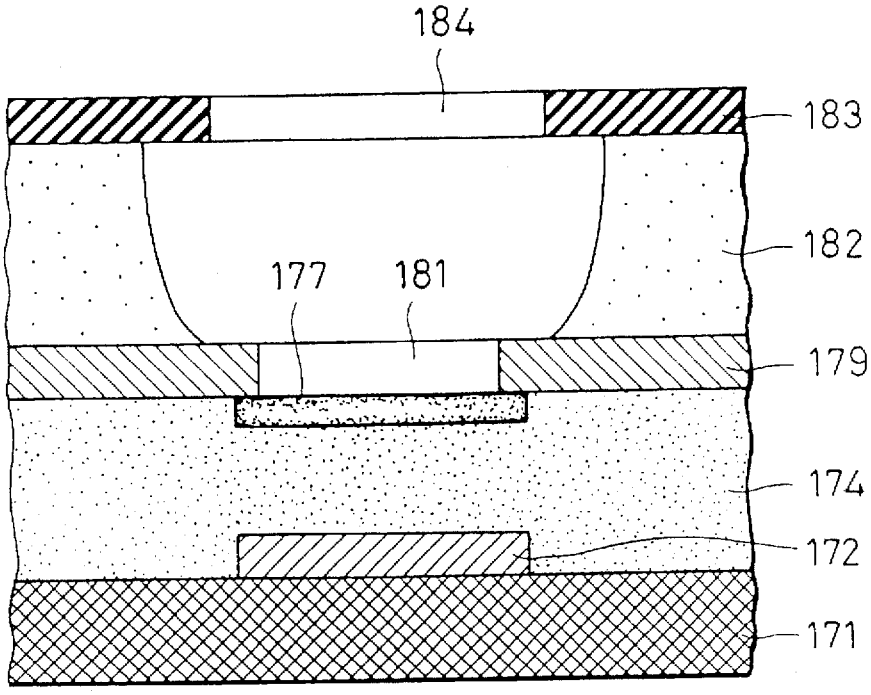

A titanium film to be used as a finger electrode is then deposited by means of for example sputtering so that the titanium film has a thickness of about 1 μm. A finger hole resist pattern 180 is then formed thereon. The titanium film is etched by means of either isotropic or anisotropic etching using the resist 180 as an etching mask thereby forming a finger electrode 179 having a finger hole 181 as shown in FIG. 33G. Then as shown in FIG. 33H, after removing the resist 180, an insulating film 182 having a charge transmission hole in its central part is formed of a material having good heat resistance such as polyimide. Subsequently, a screen electrode 183 having a screen hole 184 in its central region is formed. Thus a complete charge generation controlling device according to the eleventh embodiment is obtained.

Although, in this embodiment, titanium is employed as the material of the line electrode, other materials having a relatively low resistivity such as aluminum, copper, molybdenum, or tungsten may also be employed. As for the dielectric film, in addition to silicon oxide employed in the embodiment described above, other materials such as a silicon oxide film doped with impurities such as phosphorus (P), or boron (B), or otherwise an SOG (spin-on-glass) film may also be employed.

Furthermore, in the embodiment described above, although a silicon nitride film formed using a plasma CVD technique is employed as the protective insulating film having properties different form those of the dielectric film, other insulating materials such as alumina ($A1_2O_3$), magnesium oxide (MgO), titanium oxide ($TiO_2$), boron nitride (BN), phosphorus pentaoxide ($P_2O_5$), boron oxide ($B_2O_3$), lead oxide (PbO), aluminosilicate glass ($A1_6Si_2O_{13}$), diamond-like carbon (DLC), zinc oxide ($Zn0_2$), zirconium oxide ($ZrO_2$), calcium fluoride ($CaF_2$), or silicon carbide (SIC) may also be employed.

In this embodiment, as described above, the protective insulating film consisting of a hard and dense insulating film such as silicon nitride or alumina is selectively formed only in the region inside the finger hole 181 exposed to a corona discharge. As a result, not only the erosion of the dielectric film due to the corona discharge is prevented, but also the cracking of the dielectric film and the bowing of the insulating substrate are prevented, and thus the durability is greatly improved. Furthermore, since the protective insulating film 177 is embedded in the dielectric film 174, the finger electrode 179 can have a shape similar to that employed in the conventional technique, and therefore, no abnormal discharge due to a protrusion occurs.

Figure 34:
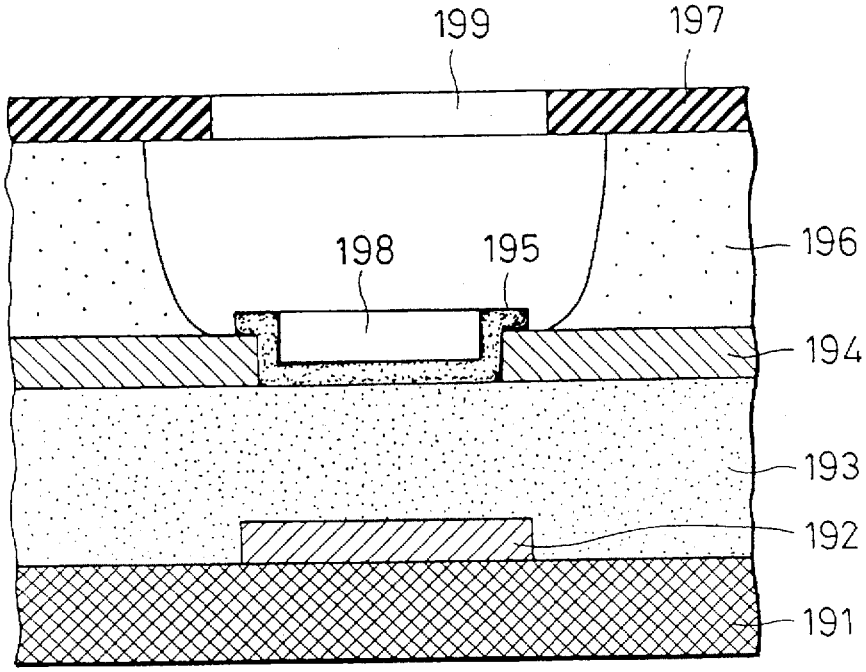
FIG. 34 is a cross-sectional view illustrating a twelfth embodiment of the invention.

Referring to FIG. 34, a twelfth embodiment will be described below. A line electrode 192 is formed on a quartz (glass) substrate 191 in the same manner as in the tenth or eleventh embodiment. Then a dielectric film 193 of silicon oxide is formed. Subsequently, a finger electrode 194 having a finger hole 198 in its central part is formed. A silicon nitride film (or an alumina film) is formed on the entire area by means of for example plasma CVD. Then a resist pattern, having a size which is about 1 μm greater than the size of a finger hole, is formed on the silicon nitride film, and the portion of the silicon nitride film not covered by the resist pattern is removed by means of etching so that a protective insulating film 195 consisting of a dense and hard silicon nitride film is selectively formed at the bottom of and on the side wall of the finger hole 198. Then an insulating film 196 is formed of a material having good heat resistance such as polyimide. Subsequently, a screen electrode 197 having a screen hole 199 in its central region is formed. Thus, a complete charge generation controlling device having the structure shown in FIG. 34 is obtained.

Also in this embodiment, the protective insulating film consisting of a hard and dense insulating film such as silicon nitride or alumina is selectively formed only in the region inside the finger hole exposed to a corona discharge. As a result, not only the erosion of the dielectric film due to the corona discharge is prevented, but also the cracking of the dielectric film and the bowing of the insulating substrate are prevented, and thus the durability is greatly improved.

What is claimed is:

1. An electric charge generator for use in an apparatus for producing an electrostatic latent image, said electric charge generator comprising a plurality of charge generation controlling devices, each said charge generation controlling device comprising:

an insulating substrate;

a line electrode formed of aluminum on said insulating substrate;

a solid dielectric film formed on the surface of said line electrode;

a thin film having greater hardness than aluminum, said thin film being disposed between said line electrode and said solid dielectric film;

a finger electrode having a hole for generating an electric charge, said hole being formed in the central part of said finger electrode, said finger electrode being formed on said solid dielectric film;

a solid insulating film having a hole for passing the electric charge, said hole being formed in the central part of said solid insulating film, said solid insulating film being formed on said finger electrode; and a screen electrode having a hole for ejecting the electric charge, said hole being formed in the central part of said screen electrode, said screen electrode being formed on the surface of said finger electrode via said solid insulating film;

wherein said plurality of charge generation controlling devices are arranged on said insulating substrate so as to form said electric charge generator.

2. An electric charge generator for use in an apparatus for producing an electrostatic latent image, according to claim 1, wherein said hard thin film is made of a material selected from the group including titanium, molybdenum, tungsten and titanium nitride.

3. An electric charge generator for use in an apparatus for producing an electrostatic latent image, according to claim 1, wherein said hard thin film is made of alumina.

4. An electric charge generator for use in an apparatus for producing an electrostatic latent image, said electric charge generator comprising a plurality of charge generation controlling devices, said plurality of charge generation controlling devices comprising:

an insulating substrate;

a plurality of line electrodes formed on said insulating substrate;

a solid dielectric film formed on the surface of each of said line electrodes;

a finger electrode having a hole for generating an electric charge, said hole being formed in the central part of said finger electrode, said finger electrode being formed on said solid dielectric film;

a solid insulating film having a hole for passing the electric charge, said hole being formed in the central part of said solid insulating film, said solid insulating film being formed on said finger electrode; and a screen electrode having a hole for ejecting the electric charge, said hole being formed in the central part of said screen electrode, said screen electrode being formed on the surface of said finger electrode via said solid insulating film;

wherein said plurality of charge generation controlling devices are arranged on said insulating substrate so as to form said electric charge generator, said plurality of line electrodes including line electrode pads, and interconnection parts between each of said plurality of line electrodes, said line electrode pads being formed using a metal layer extending across said plurality of line electrodes.

5. An electric charge generator for use in an apparatus for producing an electrostatic latent image, according to claim 4, wherein said metal layer extending across said plurality of line electrodes is formed using the same metal layer as that forming said finger electrode.

6. An electric charge generator for use in an apparatus for producing an electrostatic latent image, said electric charge generator comprising a plurality of charge generation controlling devices, each said charge generation controlling device comprising:

an insulating substrate;

a line electrode formed on said insulating substrate;

a solid dielectric film formed on the surface of said line electrode;

a finger electrode having a hole for generating an electric charge, said hole being formed in the central part of said finger electrode, said finger electrode being formed on said solid dielectric film;

a solid insulating film having a hole for passing the electric charge, said hole being formed in the central part of said solid insulating film, said solid insulating film being formed on said finger electrode;

a screen electrode having a hole for ejecting the electric charge, said hole being formed in the central part of said screen electrode, said screen electrode being formed on the surface of said finger electrode via said solid insulating film; and a protective insulating film formed selectively on an area of the surface of said solid dielectric film, said area corresponding to the hole of said finger electrode, and also on a peripheral area adjacent to said area, said protective insulating film being harder and denser than said solid dielectric film;

wherein said plurality of charge generation controlling devices are arranged on said insulating substrate so as to form said electric charge generator.

7. An electric charge generator for use in an apparatus for producing an electrostatic latent image, according to claim 6, wherein said protective insulating film is formed in such a manner that its peripheral portion is sandwiched by said solid dielectric film and said finger electrode.

8. An electric charge generator for use in an apparatus for producing an electrostatic latent image, according to claim 6 or 7, wherein said protective insulating film is a thin film made of a material selected from the group including SiN, SiON, $A1_2O_3$, $TiO_2$, MgO, BN, $P_2O_5$, $B_2O_3$, PbO, $Ta_2O_5$, $ZnO_2$, $ZFO_2$, $A1_6Si_2O_{13}$, $CaF_2$, SiC, DLC.

* * * * *